US008305417B2

(12) United States Patent
Ohno

(10) Patent No.: US 8,305,417 B2
(45) Date of Patent: Nov. 6, 2012

(54) LIGHT-EMITTING DEVICE, PRINT HEAD AND IMAGE FORMING APPARATUS

(75) Inventor: Seiji Ohno, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 489 days.

(21) Appl. No.: 12/555,028

(22) Filed: Sep. 8, 2009

(65) Prior Publication Data

US 2010/0231682 A1 Sep. 16, 2010

(30) Foreign Application Priority Data

Mar. 16, 2009 (JP) ..... 2009-063006

(51) Int. Cl.
*B41J 2/45* (2006.01)

(52) U.S. Cl. ..... 347/238

(58) Field of Classification Search ..... 347/226, 347/238, 241, 256; 438/29, 31, 32, 584; 372/45.011, 46.013, 46.012, 49.01, 50.121, 372/50.123

See application file for complete search history.

(56) References Cited

U.S. PATENT DOCUMENTS

| | | | | |
|---|---|---|---|---|
| 7,518,153 | B2 | 4/2009 | Usuda et al. | |
| 7,995,634 | B2 * | 8/2011 | Kitano et al. | 372/46.015 |
| 2008/0179606 | A1 | 7/2008 | Usuda et al. | |
| 2008/0308833 | A1 | 12/2008 | Moriyama et al. | |

FOREIGN PATENT DOCUMENTS

| | | | |
|---|---|---|---|
| JP | 07192607 | A * | 7/1995 |
| JP | 07-202257 | | 8/1995 |
| JP | 2008-021785 | | 1/2008 |
| JP | 2008-182110 | | 8/2008 |
| JP | 2008-294306 | | 12/2008 |

* cited by examiner

*Primary Examiner* — Hai C Pham

(74) *Attorney, Agent, or Firm* — Fildes & Outland, P.C.

(57) ABSTRACT

A light-emitting device includes: a substrate; a reflection layer that is provided on the substrate, and that reflects light in a wavelength band set in advance; and a light-emitting layer that is provided on the reflection layer, and that includes a light-emitting region emitting light having wavelengths overlapping in the wavelength band and a surface having unevenness at plural distances from the reflection layer. The surface is provided on a side opposite to the reflection layer across the light-emitting region. The plural distances are set so that wavelengths forming standing waves depending on each of the distances in the wavelength band are interposed each other.

7 Claims, 20 Drawing Sheets

86
80
81
82
83
84
85
60
142
133
132
141
131
122
121
R3
T3
L3

C1(C)
VIB
VII
VII
VIB
80
71
72
73
74
Vga
φ1
φ2
φ1
R1A
R2A
144
145
143
Ds
R1
R2
R3
R4
R255
R256
D1
D2
D3
D4
D255
G1
G2
G3
G4
G255
G256
T1(T)
T2
T3
T4
T255
T256
L1(L)
L2
L3
L4
L255
L256
142
133
132
131
122
121
141

LIGHT-EMITTING DEVICE, PRINT HEAD AND IMAGE FORMING APPARATUS

CROSS REFERENCE TO RELATED APPLICATIONS

This application is based on and claims priority under 35 USC §119 from Japanese Patent Application No. 2009-063006 filed Mar. 16, 2009.

BACKGROUND

1. Technical Field

The present invention relates to a light-emitting device, a print head and an image forming apparatus.

2. Related Art

In an electrophotographic image forming apparatus such as a printer, a copier or a facsimile machine, an image is formed on a recording paper sheet as follows. Firstly, an electrostatic latent image is formed on a uniformly charged photoconductor by causing an optical recording unit to emit light so as to transfer image information onto the photoconductor. Then, the electrostatic latent image is made visible by being developed with toner. Lastly, the toner image is transferred on and fixed to the recording paper sheet. In addition to an optical-scanning recording unit that performs exposure by laser scanning in the first scan direction using a laser beam, a recording device using the following LED print head (LPH) has been employed as such an optical recording unit in recent years in response to demand for downsizing the apparatus. This LPH includes a large number of light emitting diodes (LEDs), serving as light-emitting elements, arrayed in the first scan direction.

SUMMARY

According to an aspect of the present invention, there is provided a light-emitting device including: a substrate; a reflection layer that is provided on the substrate, and that reflects light in a wavelength band set in advance; and a light-emitting layer that is provided on the reflection layer, and that includes a light-emitting region emitting light having wavelengths overlapping in the wavelength band and a surface having unevenness at plural distances from the reflection layer. The surface is provided on a side opposite to the reflection layer across the light-emitting region. The plural distances are set so that wavelengths forming standing waves depending on each of the distances in the wavelength band are interposed each other.

BRIEF DESCRIPTION OF THE DRAWINGS

Exemplary embodiment(s) of the present invention will be described in detail based on the following figures, wherein.

DETAILED DESCRIPTION

Hereinafter, a detailed description will be given of a best mode (hereinafter referred to as exemplary embodiment) for carrying out the present invention with reference to the accompanying drawings.

First Exemplary Embodiment

Figure 1:
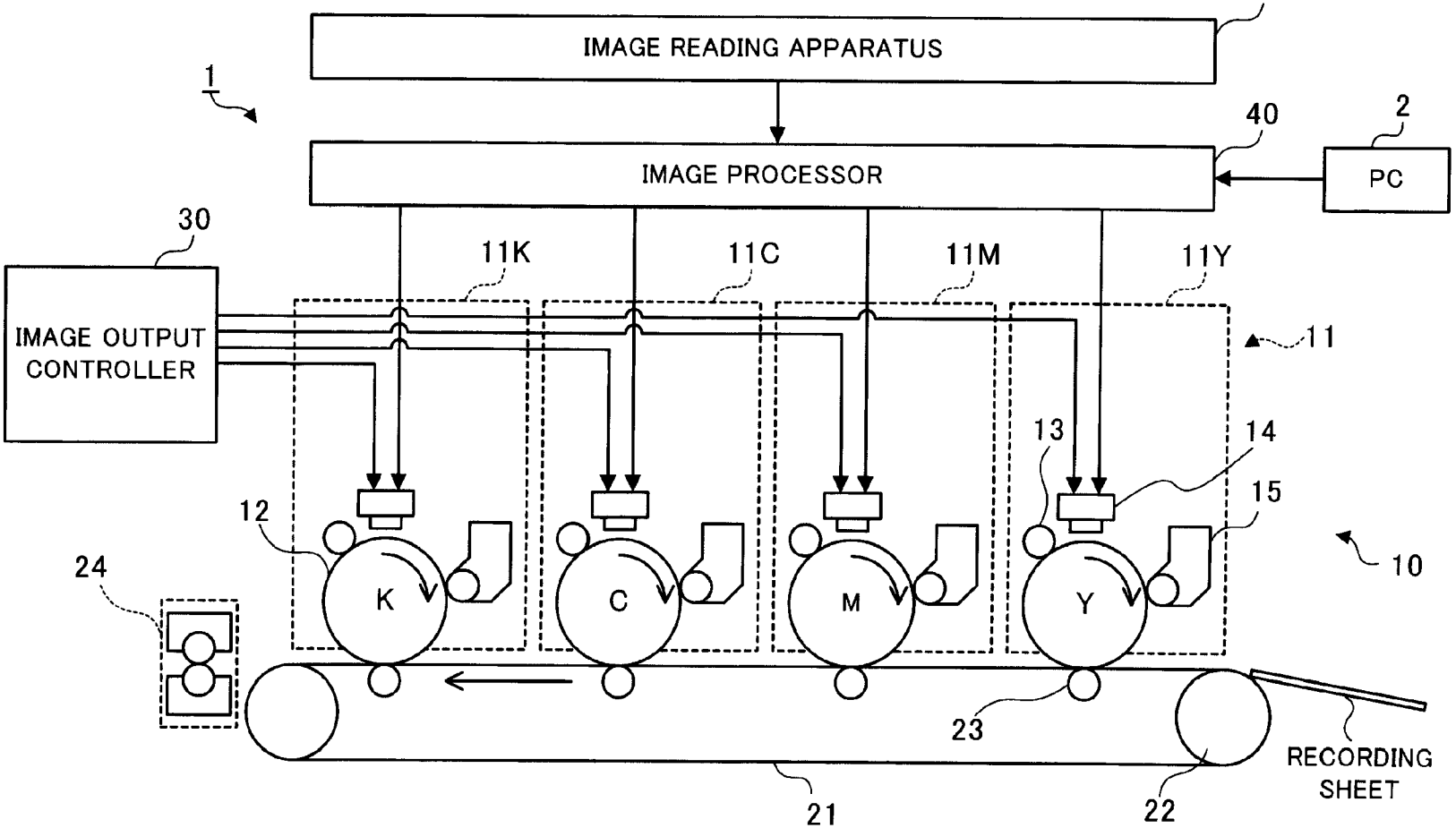
FIG. 1 is a diagram showing an example of an overall configuration of an image forming apparatus to which the present exemplary embodiment is applied.

FIG. 1 is a diagram showing an example of an overall configuration of an image forming apparatus 1 to which the present exemplary embodiment is applied. The image forming apparatus 1 shown in FIG. 1 is what is generally termed as a tandem image forming apparatus. The image forming apparatus 1 includes an image forming process unit 10, an image output controller 30 and an image processor 40. The image forming process unit 10 forms an image in accordance with different color image data sets. The image output controller 30 controls the image forming process unit 10. The image processor 40, which is connected to devices such as a personal computer (PC) 2 and an image reading apparatus 3, performs predefined image processing on image data received from the above devices.

The image forming process unit 10 includes image forming units 11. The image forming units 11 are formed of multiple engines placed in parallel at regular intervals. Specifically, the image forming units 11 are formed of four image forming units 11Y, 11M, 11C and 11K. Each of the image forming units 11Y, 11M, 11C and 11K includes a photoconductive drum 12, a charging device 13, a print head 14 and a developing device 15. On the photoconductive drum 12, which is an example of an image carrier, an electrostatic latent image is formed, and the photoconductive drum 12 retains a toner image. The charging device 13, an example of a charging unit, uniformly charges the surface of the photoconductive drum 12 at a predetermined potential. The print head 14 exposes the photoconductive drum 12 charged by the charging device 13. The developing device 15, an example of a developing unit, develops an electrostatic latent image formed by the print head 14. Here, the image forming units 11Y, 11M, 11C and 11K have approximately the same configuration except for color of toner put in the developing device 15. The image forming units 11Y, 11M, 11C and 11K form yellow (Y), magenta (M), cyan (C) and black (K) toner images, respectively.

In addition, the image forming process unit 10 further includes a sheet transport belt 21, a drive roll 22, transfer rolls 23 and a fixing device 24. The sheet transport belt 21 transports a recording sheet so that different color toner images respectively formed on the photoconductive drums 12 of the image forming units 11Y, 11M, 11C and 11K are transferred on the recording sheet by multilayer transfer. The drive roll 22 drives the sheet transport belt 21. Each transfer roll 23, an example of a transfer unit, transfers a toner image formed on the corresponding photoconductive drum 12 onto the recording sheet. The fixing device 24 fixes the toner images on the recording sheet.

Figure 2:
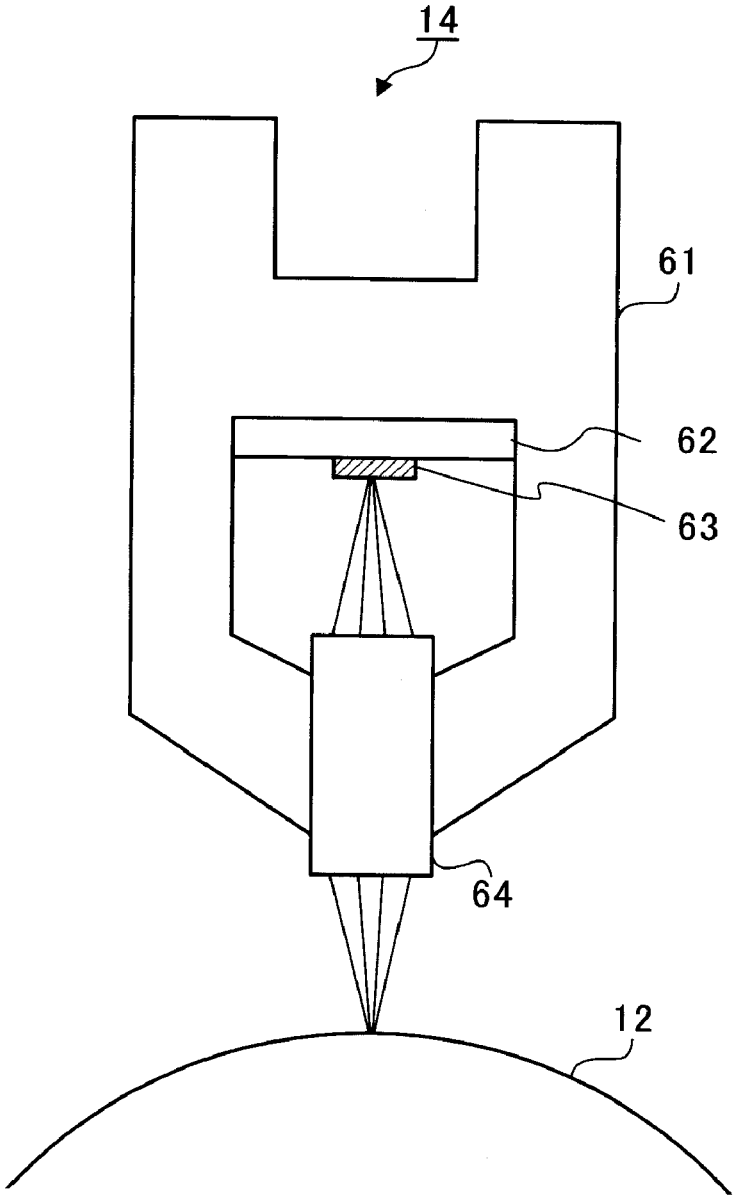
FIG. 2 is a diagram showing a structure of the print head to which the present exemplary embodiment is applied.

FIG. 2 is a diagram showing a structure of the print head 14 to which the present exemplary embodiment is applied. The print head 14 includes a housing 61, a light-emitting portion 63, a circuit board 62 and a rod lens array 64. The light-emitting portion 63, an example of an exposure unit, includes multiple LEDs (light-emitting thyristors in the present exemplary embodiment). On the circuit board 62, the light-emitting portion 63, a signal generating circuit 100 (see FIG. 3 to be described later) driving the light-emitting portion 63, and the like are mounted. The rod lens array 64, an example of an optical unit, focuses light emitted by the light-emitting portion 63 onto the surface of the photoconductive drum 12.

The housing 61 is made of metal, for example, and supports the circuit board 62 and the rod lens array 64. The housing 61 is set so that the light-emitting point of the light-emitting portion 63 is located on the focal plane of the rod lens array 64. In addition, the rod lens array 64 is arranged along an axial direction of the photoconductive drum 12.

Figure 3:
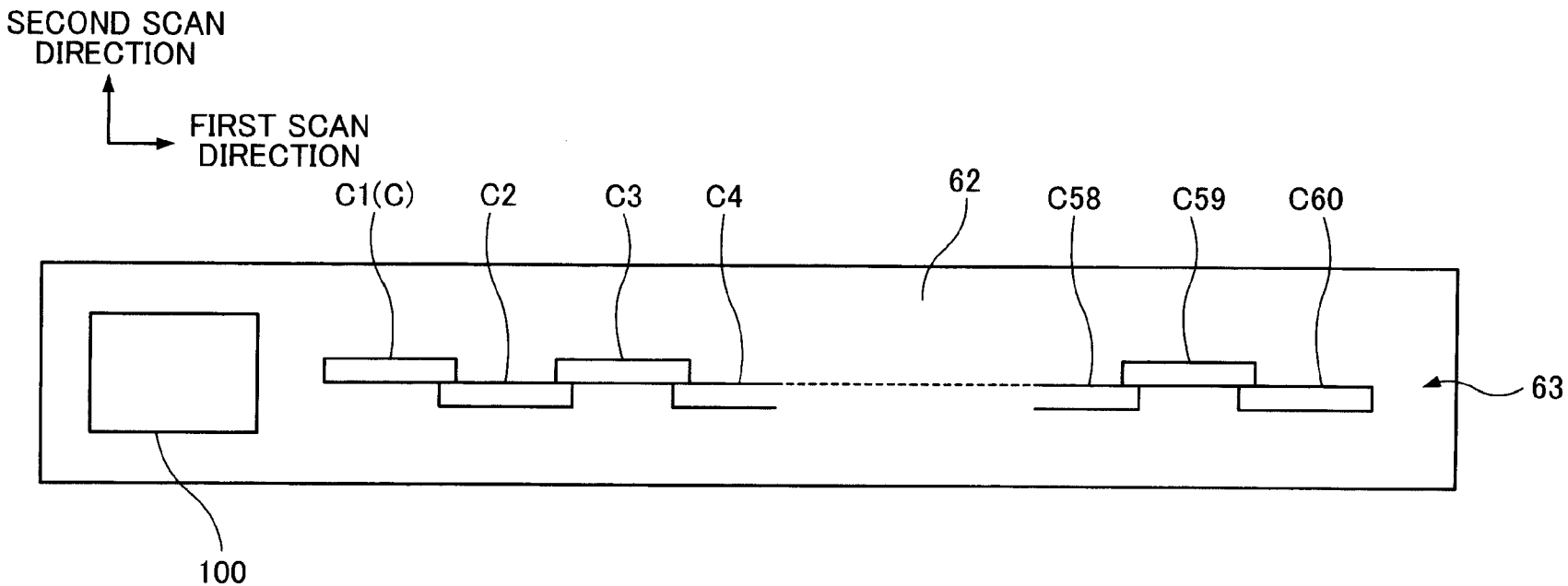
FIG. 3 is a top view of the circuit board and the light-emitting portion in the print head.

FIG. 3 is a top view of the circuit board 62 and the light-emitting portion 63 in the print head 14.

As shown in FIG. 3, the light-emitting portion 63 is formed of 60 light-emitting chips C (C1 to C60), each of which is an example of a light-emitting device, arrayed on the circuit board 62 in two straight lines of a zigzag pattern extending in the first scan direction.

Figure 4:
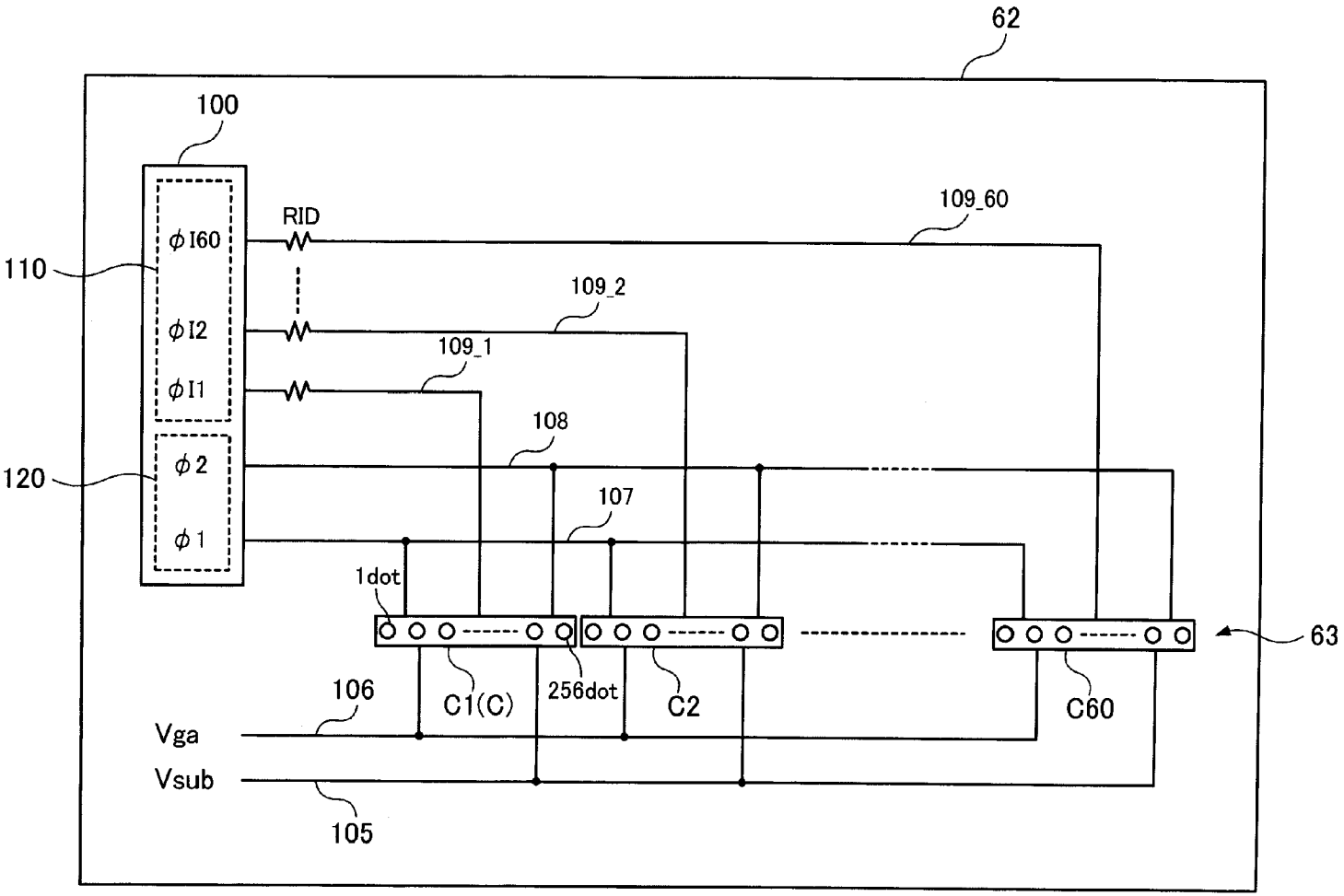
FIG. 4 is a diagram showing a configuration of the signal generating circuit mounted on the circuit board and a wiring configuration of the circuit board.

FIG. 4 is a diagram showing a configuration of the signal generating circuit 100 mounted on the circuit board 62 (see FIG. 2), and a wiring configuration of the circuit board 62.

Although not shown in FIG. 4, from the image output controller 30 and the image processor 40 (see FIG. 1), various control signals and image data on which the image processing has been performed are inputted to the signal generating circuit 100. The signal generating circuit 100 includes a light-emission signal generating unit 110. Based on the image data and the various control signals, the light-emission signal generating unit 110 performs processing such as the sorting of the image data and correction of the light-emission intensity. Then, the light-emission signal generating unit 110 outputs a light-emission signal ϕI (ϕI1 to ϕI60) to the respective light-emitting chips C (C1 to C60).

In addition, the signal generating circuit 100 further includes a transfer signal generating unit 120. Based on the various control signals, the transfer signal generating unit 120 generates and outputs a first transfer signal ϕ1 and a second transfer signal ϕ2 to the light-emitting chips C1 to C60.

The circuit board 62 is provided with a power supply line 105 and a power supply line 106. The power supply line 105 is connected to a Vsub terminal (not shown in FIG. 4) of the respective light-emitting chips C (C1 to C60), and a reference potential Vsub (0 V, for example) is supplied to the light-emitting chips C (C1 to C60) through the power supply line 105. The power supply line 106 is connected to Vga terminals (not shown in FIG. 4) of the respective light-emitting chips C (C1 to C60), and a power supply potential Vga (−3.3 V, for example) for power supply is supplied to the light-emitting chips C (C1 to C60) through the power supply line 106.

The circuit board 62 is also provided with a first transfer signal line 107, a second transfer signal line 108, 60 light-emission signal lines 109 (109_1 to 109_60) and 60 light-emission current limiting resistors RID. Through the first and second transfer signal lines 107 and 108, the transfer signal generating unit 120 of the signal generating circuit 100 respectively transmits the first and second transfer signals ϕ1 and ϕ2 to the light-emitting portion 63. Through the light-emission signal lines 109 (109_1 to 109_60), the light-emission signal generating unit 110 of the signal generating circuit 100 transmits the light-emission signals ϕI (ϕI1 to ϕI60) to the light-emitting chips C1 to C60, respectively. The light-emission current limiting resistors RID are provided to prevent excessive currents from flowing through the 60 light-emission signal lines 109 (109_1 to 109_60), respectively.

Figure 5:
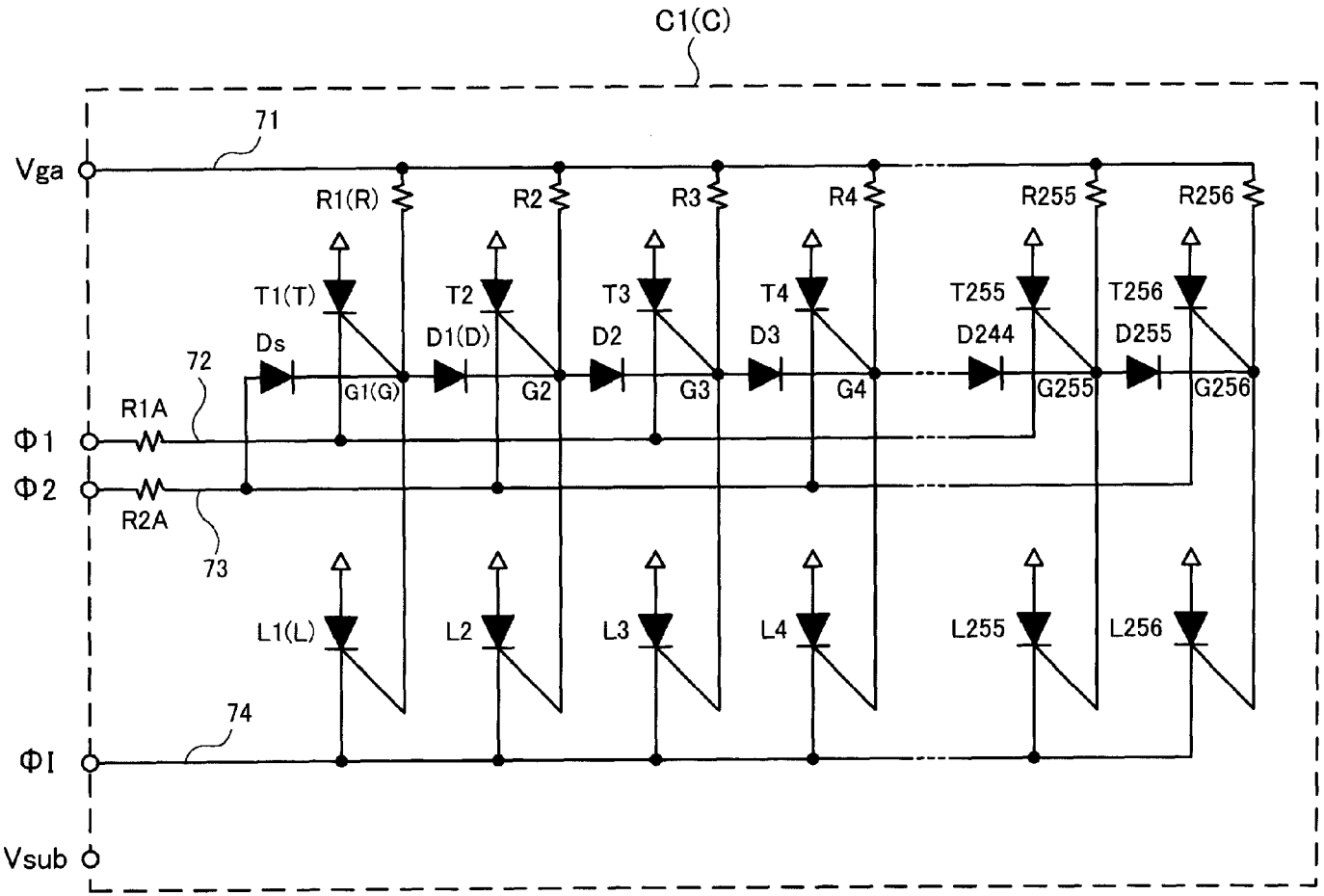
FIG. 5 is a diagram for illustrating a circuit configuration of each light-emitting chip.

FIG. 5 is a diagram for illustrating a circuit configuration of each light-emitting chip C. Note that, although the light-emitting chip C1 is used as an example in the following description, the other light-emitting chips C2 to C60 have the same configuration as that of the light-emitting chip C1.

The light-emitting chip C1 includes 256 transfer thyristors T1 to T256, 256 light-emitting thyristors L1 to L256, 255 diodes D1 to D255, a start diode Ds, 256 resistors R1 to R256 and transfer current limiting resistors R1A and R2A. The transfer current limiting resistors R1A and R2A prevent excessive currents from flowing through the signal lines (the first and second transfer signal lines 107 and 108) for supplying the first and second transfer signals ϕ1 and ϕ2, respectively.

The light-emitting thyristors L1 to L256 are arrayed in the order of L1, L2, . . . , L255, L256 from the left of FIG. 5. Similarly, the transfer thyristors T1 to T256 are also arrayed in the order of T1, T2, . . . , T255, T256 from the left of FIG. 5. Further, the diodes D1 to D255 are also arrayed in the order of D1, D2, . . . , D254, D255 from the left of FIG. 5. Furthermore, the resistors R1 to R256 are also arrayed in the order of R1, R2, . . . , R255, R256 from the left of FIG. 5.

Note that, when need not be distinguished from one another, the transfer thyristors T1 to T256 will be referred to as transfer thyristors T. Meanwhile, when need not be distinguished from one another, the light-emitting thyristors L1 to L256 will be referred to as light-emitting thyristors L. Similarly, when need not be distinguished from one another, the diodes D1 to D255 will be referred to as diodes D. When need not be distinguished from one another, the resistors R1 to R256 will be referred to as resistors R.

Next, a description will be given of electrical connection among the elements in the light-emitting chip C1.

Anode terminals of the transfer thyristors T1 to T256 and the light-emitting thyristors L1 to L256 are connected to a board of the light-emitting chip C1 (see FIGS. 6A and 6B to be described later). Thereby, these anode terminals are connected to the power supply line 105 (see FIG. 4) via the Vsub terminal provided on the board. The reference potential Vsub (0 V, for example) is supplied through the power supply line 105.

Meanwhile, gate terminals G1 to G256 of the transfer thyristors T1 to T256 are connected to a power supply line 71 via the resistors R1 to R256, which are provided for the respective transfer thyristors T1 to T256, respectively. The power supply line 71 is connected to the Vga terminal. The Vga terminal is connected to the power supply line 106 (see FIG. 4) and supplied with the power supply voltage Vga (−3.3 V, for example).

Cathode terminals of the odd-numbered transfer thyristors T1, T3, . . . , T255 are connected to a first transfer signal line 72, and thus connected to a ϕ1 terminal via the transfer current limiting resistor R1A. The ϕ1 terminal is an input terminal for the first transfer signal ϕ1. The ϕ1 terminal is connected to the first transfer signal line 107 (see FIG. 4), and supplied with the first transfer signal ϕ1 therethrough.

On the other hand, cathode terminals of the even-numbered transfer thyristors T2, T4, . . . , T256 are connected to a second transfer signal line 73, and thus connected to a ϕ2 terminal via the transfer current limiting resistor R2A. The ϕ2 terminal is an input terminal for the second transfer signal ϕ2. The ϕ2 terminal is connected to the second transfer signal line 108 (see FIG. 4), and supplied with the second transfer signal ϕ2 therethrough.

Additionally, the gate terminals G1 to G256 of the transfer thyristors T1 to T256 are connected to gate terminals of the respective light-emitting thyristors L1 to L256 in one-to-one correspondence. Accordingly, the gate terminals of the light-emitting thyristors L1 to L256 will not hereinafter be distinguished from the gate terminals G1 to G256 of the transfer thyristors T1 to T256, and thus will be also referred to as gate terminals G1 to G256, respectively. When need not be distinguished from one another, the gate terminals G1 to G256 will be referred to as gate terminals G.

Furthermore, the gate terminals G1 to G255 of the transfer thyristors T1 to T255 are connected to anode terminals of the diodes D1 to D255, respectively. The gate terminals G2 to G256 of the transfer thyristors T2 to T256 are connected to cathode terminals of the diodes D1 to D255, respectively. That is, the diodes D1 to D255 are connected in series with one of the diodes D1 to D255 interposed between each adjacent two of the gate terminals G1 to G256.

In addition, the gate terminal G1 of the transfer thyristor T1 is connected to a cathode terminal of the start diode Ds. Meanwhile, an anode terminal of the start diode Ds is connected to the second transfer signal line 73 to which the cathode terminals of the even-numbered thyristors T2, T4, . . . , T256 are connected. Thereby, the anode terminal of the start diode Ds is supplied with the second transfer signal ϕ2 via the transfer current limiting resistor R2A.

Cathode terminals of the light-emitting thyristors L1 to L256 are connected to a first light-emission signal line 74, and thus connected to a ϕI terminal. The ϕI terminal is connected to the light-emission signal line 109 (see FIG. 4: the light-emission signal line 109_1 for the light-emitting chip C1), and supplied with the light-emission signal ϕI (see FIG. 4: the light-emission signal ϕI1 for the light-emitting chip C1) therethrough.

Figure 6B:
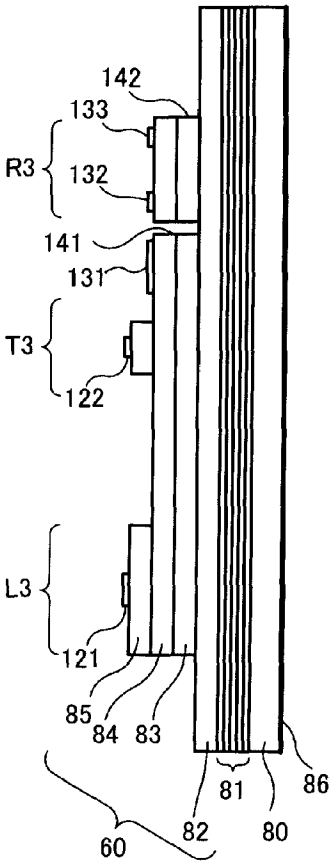
FIGS. 6A and 6B are diagrams for illustrating a planar layout and a cross-sectional structure of the light-emitting chip.
Figure 6A:
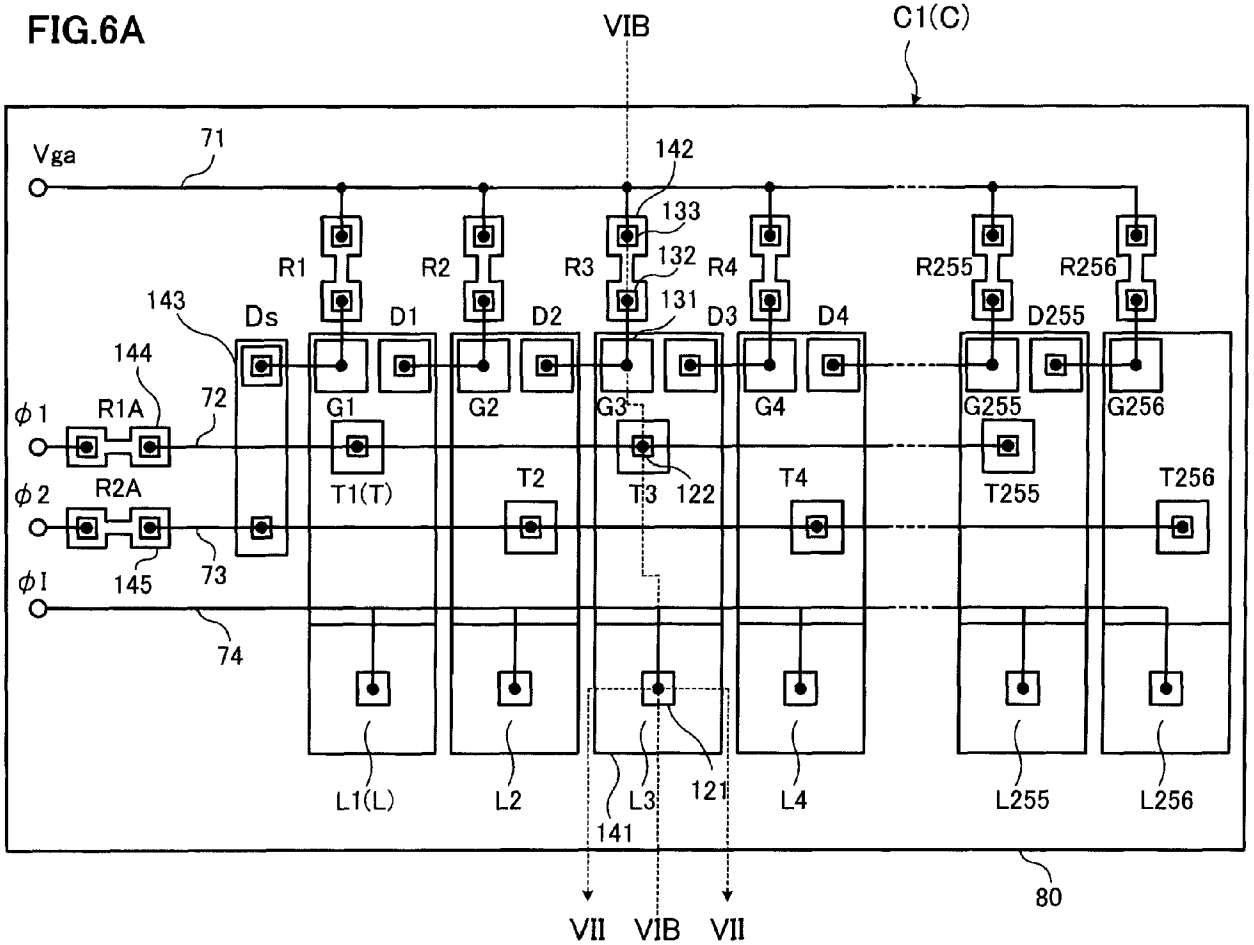

FIG. 6A is a diagram for illustrating a planar layout of the light-emitting chip C. FIG. 6B is a diagram for illustrating a cross-sectional structure taken along the VIB-VIB line of FIG. 6A. That is, FIG. 6B shows cross sections of the light-emitting thyristor L3, the transfer thyristor T3 and the resistor R3. Although the light-emitting chip C1 is used as an example in the following description as well, the other light-emitting chips C2 to C60 have the same configuration as that of the light-emitting chip C1, as described above.

Firstly, the planar layout of the light-emitting chip C1 will be described.

As shown in FIG. 6A, the light-emitting chip C1 includes, on a substrate 80, 256 first islands 141, 256 second islands 142, a third island 143, a fourth island 144 and a fifth island 145. In each of the first islands 141, one of the light-emitting thyristors L1 to L256, the corresponding one of the transfer thyristors T1 to T256, and the corresponding one of the diodes D1 to D255 are formed (The light-emitting thyristor L3, the transfer thyristor T3 and the diode D3 are formed in one of the first islands 141, for example). In each of the second islands 142, one of the resistors R1 to R256 is formed (The resistor R3 is formed in one of the second islands 142, for example). In the third island 143, the start diode Ds is formed. In the fourth and fifth islands 144 and 145, the transfer current limiting resistors R1A and R2A are formed, respectively.

Next, the cross-sectional structure of the light-emitting chip C1 (cross-sectional structure taken along the VIB-VIB line of FIG. 6A) will be described. That is, a description will be given by taking the light-emitting thyristor L3, the transfer thyristor T3 and the resistor R3 as an example.

As shown in FIG. 6B, the light-emitting chip C1 has a structure in which a distributed Bragg reflection layer 81, a p-type first semiconductor layer 82, an n-type second semiconductor layer 83, a p-type third semiconductor layer 84 and an n-type fourth semiconductor layer 85 are stacked on the p-type substrate 80 in this order. The distributed Bragg reflection layer 81 is an example of a reflection layer.

Here, the layers stacked on the distributed Bragg reflection layer 81, namely, the p-type first semiconductor layer 82, the n-type second semiconductor layer 83, the p-type third semiconductor layer 84 and the n-type fourth semiconductor layer 85, will be referred to as semiconductor layer 60. The semiconductor layer 60 has a pnpn thyristor structure.

Note that on the back surface of the substrate 80, a Vsub terminal 86 is formed.

The substrate 80 is made of GaAs, for example. The distributed Bragg reflection layer 81 is made of AlGaAs, for example, by alternately stacking two types of layers having mutually different Al concentrations and thus having mutually different refractive indices. The semiconductor layer 60, which is formed of the first to fourth semiconductor layers 82 to 85, is made of GaAs, for example.

In one of the first islands 141, the light-emitting thyristor L3 is formed. The light-emitting thyristor L3 uses the Vsub terminal 86, an ohmic electrode 121 and an ohmic electrode 131 as the anode terminal, the cathode terminal and the gate terminal G3, respectively. Here, the ohmic electrode 121 is formed on the n-type fourth semiconductor layer 85, while the ohmic electrode 131 is formed on the p-type third semiconductor layer 84 exposed by etch removal of the n-type fourth semiconductor layer 85.

In addition, the transfer thyristor T3 is also formed in the first island 141. The transfer thyristor T3 uses the Vsub terminal 86, an ohmic electrode 122 and the ohmic electrode 131 as the anode terminal, the cathode terminal and the gate terminal G3, respectively. Here, the ohmic electrode 122 is formed on the n-type fourth semiconductor layer 85, while the ohmic electrode 131 is formed on the p-type third semiconductor layer 84.

The ohmic electrode 131 commonly serves as the gate terminal G3 of the light-emitting thyristor L3 and the transfer thyristor T3.

In addition, although not shown in FIG. 6B, the diode D3 is also formed in the first island 141. The diode D3 uses the p-type third semiconductor layer 84 and the n-type fourth semiconductor layer 85 as the anode terminal and the cathode terminal, respectively. In other words, the diode D3 is formed using a pn junction between the p-type third semiconductor layer 84 and the n-type fourth semiconductor layer 85.

As described above, the light-emitting thyristor L3, the transfer thyristor T3 and the diode D3 are formed in the first island 141.

In one of the second islands 142, the resistor R3 is formed between an ohmic electrode 132 and an ohmic electrode 133 that are formed on the p-type third semiconductor layer 84. In other words, the resistor R3 is formed using the p-type third semiconductor layer 84.

Although not shown in FIG. 6B, the start diode Ds is formed in the third island 143. Like the diode D3, the start diode Ds is formed using the p-type third semiconductor layer 84 and the n-type fourth semiconductor layer 85 as the anode terminal and the cathode terminal, respectively.

Although not shown in FIG. 6B either, the transfer current limiting resistors R1A and R2A are formed respectively in the fourth and fifth islands 144 and 145. These resistors are formed using the p-type third semiconductor layer 84, like the resistor R3.

Moreover, although not shown in FIG. 6B, each of the ohmic electrodes 121, 122, 131, 132 and 133 is connected to an interconnect, which is made of gold (Au), for example, through a through hole (opening) of a protective film layer formed on the ohmic electrodes.

The same holds true for the other light-emitting thyristors L, the other transfer thyristors T, the other diodes D and the other resistors R, and thus the description thereof is omitted herein.

Next, a description will be given of a connection relation in the planar layout of the light-emitting chip C1 shown in FIG. 6A. In the following description, the first island 141 in which the light-emitting thyristor L3, the transfer thyristor T3 and the diode D3 are formed, and the second island 142 in which the resistor R3 is formed are used as an example. However, the same holds true for the other light-emitting thyristors L, the other transfer thyristors T, the other diodes D and the other resistors R.

Although the elements are actually connected through interconnects each having a width, FIG. 6A shows the connection relation by simply connecting the elements with lines.

The gate terminal G3 (the ohmic electrode 131), which is common to the light-emitting thyristor L3 and the transfer thyristor T3, is connected to the resistor R3 (ohmic electrode 132). In addition, the gate terminal G3 is also connected to the cathode terminal of the diode D2, which is formed in an adjacent one of the first islands 141. The cathode terminal (ohmic electrode 121) of the light-emitting thyristor L3 is connected to the light-emission signal line 74, which is connected to the ϕI terminal.

The cathode terminal (ohmic electrode 122) of the odd-numbered transfer thyristor T3 is connected to the first transfer signal line 72, and thus connected to the ϕ1 terminal via the transfer current limiting resistor R1A.

Note that the cathode terminals of the respective even-numbered transfer thyristors T2, T4, . . . , T256 are connected to the second transfer signal line 73, and thus connected to the ϕ2 terminal via the transfer current limiting resistor R2A.

In addition, the ohmic electrode 133 of the resistor R3 in the second island 142 is connected to the power supply line 71, and thus connected to the Vga terminal therethrough.

Hereinafter, by using the light-emitting thyristor L3 as an example, the structure of each light-emitting thyristor L(L3) will be described in more detail.

Figure 7:
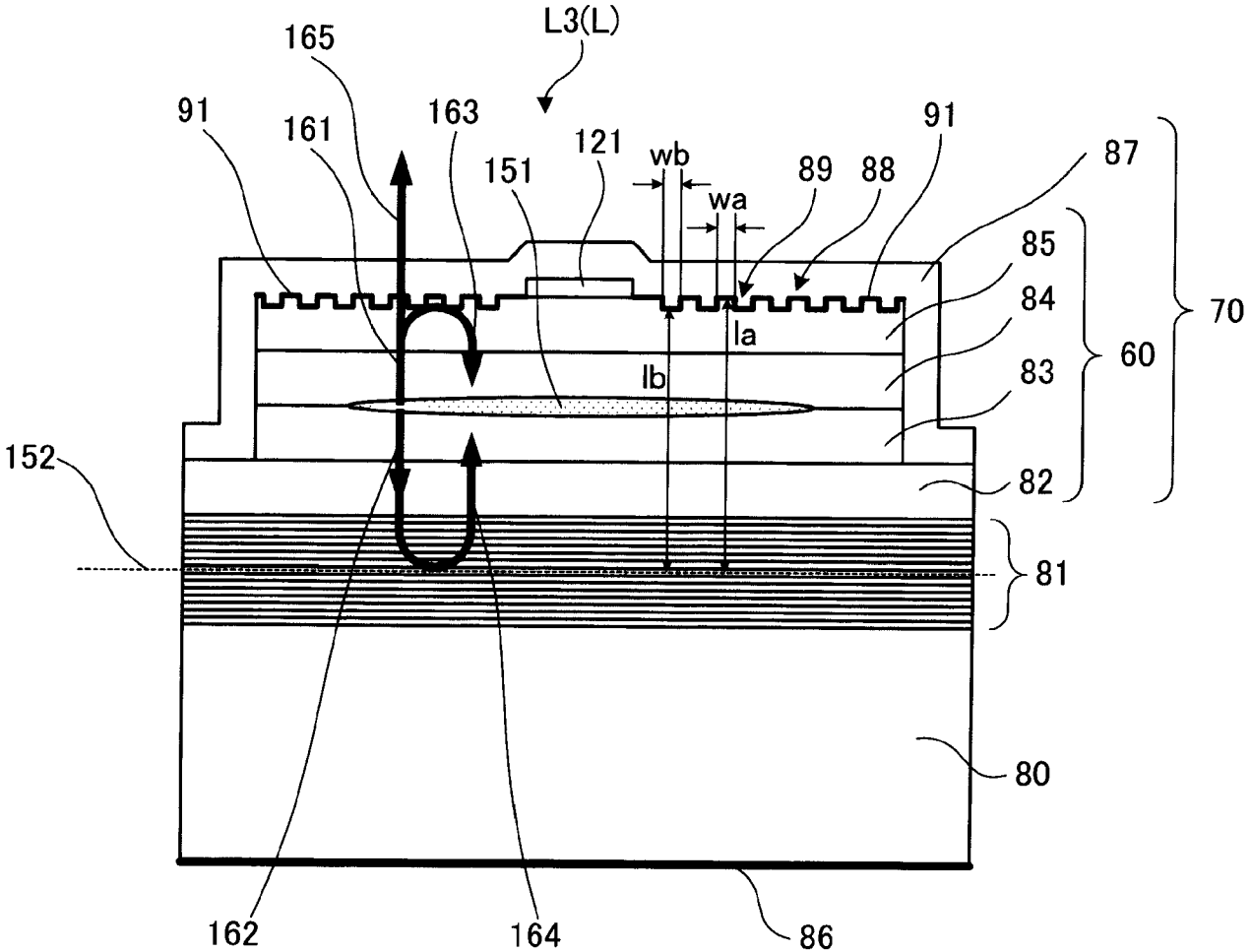
FIG. 7 is a cross-sectional view for illustrating the structure of the light-emitting thyristor according to the first exemplary embodiment.

FIG. 7 is a cross-sectional view taken along the VII-VII line of FIG. 6A for illustrating the structure of the light-emitting thyristor L in more detail. Note that the same components as those in FIG. 6B are denoted by the same reference numerals, and the detailed description thereof will be omitted.

The light-emitting thyristor L3 shown in FIG. 7 includes the distributed Bragg reflection layer 81 and the semiconductor layer 60 (a structure in which the p-type first semiconductor layer 82, the n-type second semiconductor layer 83, the p-type third semiconductor layer 84 and the n-type fourth semiconductor layer 85 are stacked in this order) on the p-type substrate 80. The light-emitting thyristor L3 further includes a protective film layer 87 (not shown in FIG. 6B) for covering the semiconductor layer 60, on the semiconductor layer 60 and the ohmic electrode 121. The semiconductor layer 60 and the protective film layer 87 for covering the semiconductor layer 60 will be collectively referred to as light-emitting layer 70, herein.

The surface, opposite to the surface in contact with the distributed Bragg reflection layer 81, of the semiconductor layer 60, is a semiconductor layer surface 91 (the surface from which light is emitted). The semiconductor layer surface 91 is made uneven and is an example of a surface having unevenness at multiple distances from the reflection layer. Specifically, regions, not provided with the ohmic electrode 121, of the surface of the fourth semiconductor layer 85 (the regions, indicated by the bold line in FIG. 7, of the surface of the fourth semiconductor layer 85) will be referred to as the semiconductor layer surface 91.

Since light beams incident on the distributed Bragg reflection layer 81 are reflected by the layers therein, no reflecting surface is physically definable in the distributed Bragg reflection layer 81. Thus, an equivalent reflecting surface 152 is set.

The uneven semiconductor layer surface 91 includes convex portions 88 and concave portions 89. From the equivalent reflecting surface 152, each convex portion 88 and each concave portion 89 are separated by a distance la and a distance lb, respectively. That is, in the present exemplary embodiment, the semiconductor layer surface 91 is an uneven surface at two distances from the equivalent reflecting surface 152. The distances la and lb are regarded as distances from the reflection layer.

Each convex portion 88 has a width wa while each concave portion 89 has a width wb. The convex portions 88 and the concave portions 89 are formed extending in the depth direction (direction perpendicular to the paper) and arranged side by side (in a stripe pattern).

Note that the surface (interface to the air) of the protective film layer 87 is actually uneven since the surface is affected by the unevenness of the semiconductor layer surface 91. However, FIG. 7 does not show the unevenness of the interface.

Hereinafter, a method for manufacturing the light-emitting chip C1 will be described in brief.

Firstly, by alternately stacking 20 pairs of AlGaAs layers by the molecular beam epitaxy (MBE) method, the distributed Bragg reflection layer 81 is formed on the substrate 80 that is made, for example, of GaAs. Here, each pair (two) of the AlGaAs layers have mutually different proportions of Al.

The reflectance properties (reflection wavelength, reflectance and reflection wavelength band r) of the distributed Bragg reflection layer 81 depend on factors such as a refractive-index difference between the layers forming each pair, the thicknesses of the respective layers forming the pair, and the number of stacked pairs. The reflection wavelength depends on the thicknesses of the respective layers forming the pair. With increase in the refractive-index difference between the layers forming the pair as well as in the number of stacked pairs, the reflectance becomes higher, and the reflection wavelength band becomes broader.

Thus, the factors such as the refractive-index difference between the layers forming each pair, the thicknesses of the respective layers and the number of stacked pairs may be set in consideration of the reflectance properties of the distributed Bragg reflection layer 81.

Then, on the distributed Bragg reflection layer 81, the p-type first semiconductor layer 82, the n-type second semiconductor layer 83, the p-type third semiconductor layer 84 and the n-type fourth semiconductor layer 85, all of which are made, for example, of GaAs, are stacked in this order.

After that, the fourth semiconductor layer 85 made of GaAs in regions where the gate terminals G each common to a transfer thyristor T and a light-emitting thyristor L are to be formed are removed by etching (gate-exposing etching).

Then, in order to form the first islands 141, the second islands 142, the third island 143, the fourth island 144 and the fifth island 145, inter-island regions of the n-type fourth semiconductor layer 85, the p-type third semiconductor layer 84 and the n-type second semiconductor layer 83 are removed by etching (element isolation etching).

Thereafter, the concave portions 89 are formed by photolithography in the surface of the n-type fourth semiconductor layer 85 in each light-emitting thyristor L, and thus the uneven semiconductor layer surface 91 is formed.

After that, the ohmic electrodes 121, 122, 131, 132 and 133 are formed.

Then, the protective film layer 87 is formed out of a material having high transmittance for the emission wavelength (center wavelength is 780 nm), such as $SiO_2$. Thereafter, the through holes (not shown in the figure) are formed by photolithography in the protective film layer 87 at positions on the ohmic electrodes 121, 122, 131, 132 and 133, respectively. Then, the interconnects 71, 72, 73 and 74 (not shown in the figure) made of, for example, Au are formed.

Lastly, the Vsub terminal 86 is provided on the back surface of the substrate 80.

Note that the n-type first semiconductor layer 82 is electrically connected to the Vsub terminal since the distributed Bragg reflection layer 81 is low in resistance.

Here, a description will be given of light beams emitted by the light-emitting thyristor L3.

As shown in FIG. 7, when the light-emitting thyristor L3 is turned on (how each light-emitting thyristor L is turned on will be described later), light beams are generated (emitted) from the junction (light-emitting region 151) between the n-type second semiconductor layer 83 and the p-type third semiconductor layer 84 in the semiconductor layer 60. Some of the light beams travel toward the uneven semiconductor layer surface 91 as light beams 161, and others travel toward the distributed Bragg reflection layer 81 as light beams 162. Some of the light beams 161 traveling toward the semiconductor layer surface 91 are emitted outside from the semiconductor layer surface 91 as light beams 165, and others are reflected by the uneven semiconductor layer surface 91 (interface between n-type GaAs and $SiO_2$), and thus travel toward the distributed Bragg reflection layer 81 as light beams 163.

Meanwhile, the light beams 162 traveling toward the distributed Bragg reflection layer 81 (including, among the above light beams 161, the light beams 163 that travel toward the distributed Bragg reflection layer 81 after reflected by the semiconductor layer surface 91) are reflected by the distributed Bragg reflection layer 81, and thus travel toward the semiconductor layer surface 91 as light beams 164. Some of the light beams 164 traveling toward the semiconductor layer surface 91 are emitted outside of the light-emitting thyristor L3 as the light beams 165, and others are reflected by the uneven semiconductor layer surface 91, and thus travel toward the distributed Bragg reflection layer 81 as the light beams 163, again. Thereafter, the light beams repeat the above behavior.

At this time, interference occurs between the light beams 163 traveling toward the distributed Bragg reflection layer 81 after reflected by the semiconductor layer surface 91 and the light beams 164 traveling toward the semiconductor layer surface 91 after reflected by the distributed Bragg reflection layer 81.

Note that, although not described above, some of the light beams 165 emitted outside from the semiconductor layer surface 91 are reflected by the interface between the protective film layer 87 and the air. Although needing to be considered, such reflection is similar to the foregoing reflection, and thus the description thereof is omitted here.

Next, a description will be given of an operation of the light-emitting portion 63. Note that the light-emitting chips C (C1 to C60) constituting the light-emitting portion 63 are driven in parallel by using the first and second transfer signals $\phi$1 and $\phi$2 supplied in common to the light-emitting chips C (C1 to C60). At the same time, the light-emission signals $\phi$I ($\phi$I1 to $\phi$I60) generated on the basis of image data are separately supplied to the respective light-emitting chips C (C1 to C60). Thereby, the light-emitting chips C (C1 to C60) emit light.

Thus, as for the operation of the light-emitting portion 63, it will be sufficient to describe the operation of the light-emitting chip C1. Accordingly, the operation of each light-emitting chip C will hereinafter be described by taking the light-emitting chip C1 as an example.

Figure 8:
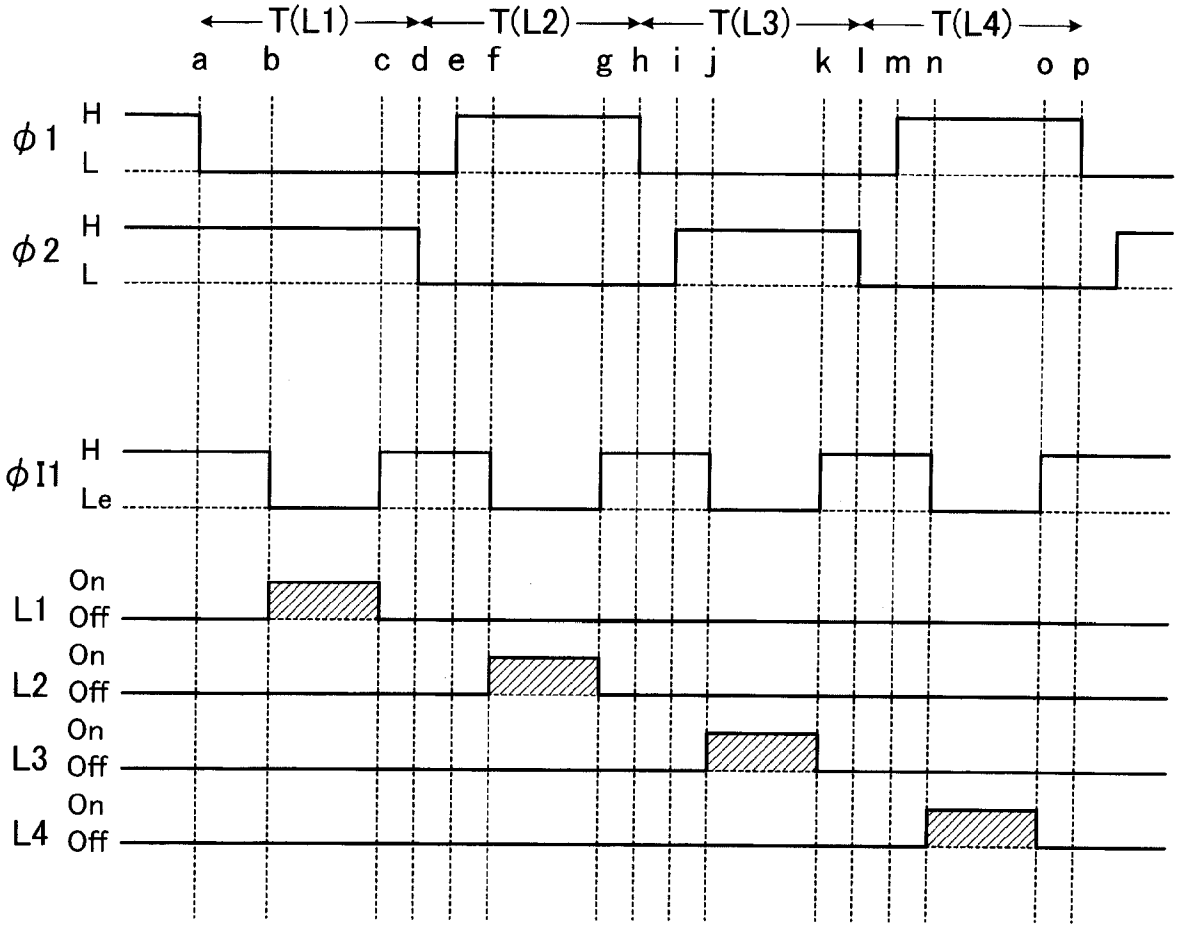
FIG. 8 is a timing chart for illustrating the operation of the light-emitting chip.

FIG. 8 is a timing chart for illustrating the operation of the light-emitting chip C1. Assume here that time flows from a time point a to a time point p in alphabetical order. Note that FIG. 8 focuses on light-emission control on the light-emitting thyristors L1 to L4 in the light-emitting chip C. In the following description, all these light-emitting thyristors L1 to L4 are caused to "emit light (be turned on)."

Firstly, waveforms of the signals driving the light-emitting chip C1 will be described.

As will be described later, the light-emitting thyristors L1 to L4 are sequentially controlled so as to emit light or not respectively during constant periods. Accordingly, assume here that the light-emission and non-light-emission of each of the light-emitting thyristors L1 to L4 is controlled during a period T as a cycle. Specifically, during a period T(L1) from the time point a to a time point d, the light-emitting thyristor L1 is controlled. During a period T(L2) from the time point d to a time point h, the light-emitting thyristor L2 is controlled. During a period T(L3) from the time point h to a time point 1, the light-emitting thyristor L3 is controlled. During a period T(L4) from the time point 1 to the time point p, the light-emitting thyristor L4 is controlled.

Hereinafter, the timing chart of FIG. 8 will be described with reference to FIG. 5.

The period T(L1) in FIG. 8 is not only a light-emission control period for the light-emitting thyristor L1, but also a period in which the drive of the light-emitting chip C1 starts. Thus, the signals have different waveforms in the period T(L1) from those in the subsequent periods. Hence, the signal waveforms will hereinafter be outlined by using the signal waveforms in the periods T(L3) and T(L4), which are to be repeated.

Each of the first and second transfer signals ϕ1 and ϕ2 repeats a cycle of total period (2×T) of the periods T(L3) and T (L4). Thus a description will be given by using the total period of the periods T(L3) and T(L4) (from the time point h to the time point p) as a unit period.

The first transfer signal ϕ1 transitions from a high level (hereinafter, referred to as "H") to a low level (hereinafter, referred to as "L") at the time point h, and then transitions from "L" to "H" at a time point m. During the other part of the unit period, the first transfer signal ϕ1 is at "H."

The second transfer signal ϕ2 is set to "L" at the time point h, and transitions from "L" to "H" at a time point i, and then transitions from "H" to "L" at the time point 1. The second transfer signal (ϕ2 is at "L" at the time point p.

Here, comparison between the first and second transfer signals ϕ1 and ϕ2 shows that the second transfer signal ϕ2 is obtained by shifting the first transfer signal ϕ1 along the time axis to the right in FIG. 8 by the period T.

The first and second transfer signals ϕ1 and ϕ2 are both set to "L" during a period from the time point h, which is the start point of the period T (L3), to the time point i, and during a period from the time point 1, which is the start point of the period T (L4), to the time point m. That is, the first and second transfer signals ϕ1 and ϕ2 are both set to "L" at the start point of each period T.

Meanwhile, the light-emission signal ϕI (the light-emission signal ϕI1 for the light-emitting chip C1) is a signal having a cycle of period T. In the period T(L3), the light-emission signal ϕI is set to "H" at the time point h, and transitions to a low level for the light-emission signal ϕI (hereinafter, referred to as "Le") at a time point j, and then from "Le" to "H" at a time point k. The light-emission signal ϕI is kept at "H" at the time point 1, which is the start point of the period T(L4). In the period T(L4), the light-emission signal ϕI transitions from "H" to "Le" at a time point n, and transitions from "Le" to "H" at a time point o.

The light-emission signal ϕI is set to "Le" during which either the first transfer signal ϕ1 or the second transfer signal ϕ2 is set to "L" (during a period from the time point i to the time point 1 for the first transfer signal ϕ1, and during a period from the time point m to the time point p for the second transfer signal ϕ2).

Hereinafter, the operation of each light-emitting chip C will be described by taking the light-emitting chip C1 as an example.

Firstly, a description will be given of an operation of each thyristor (transfer thyristor T or light-emitting thyristor L) by assuming the potential of an anode terminal of the thyristor as reference. When a potential lower than a threshold voltage is applied to the cathode terminal of a thyristor, the thyristor gets turned on. The threshold voltage of a thyristor is a value obtained by subtracting a diffusion potential Vd of the pn junction from the potential of the gate terminal G of the thyristor.

When the thyristor gets turned on, the potential of the gate terminal G of the thyristor becomes equal to the potential (anode potential) of the anode terminal. Meanwhile, the potential of the cathode terminal of the turned-on thyristor becomes equal to the diffusion potential Vd of the pn junction.

Once turned on, the thyristor is kept turned on until the potential of the cathode terminal exceeds a potential required to keep the thyristor turned on. For example, if the potential of the cathode terminal is set equal to the potential of the anode terminal, the thyristor is disabled to be kept turned on, and thus gets turned off.

When the light-emitting chip C1 is instructed to start the operation (at the time point a), the Vsub terminal is set to "H" (0 V, for example), and the Vga terminal is set to "L" (−3.3 V, for example) in the light-emitting chip C1. In addition, the transfer signal generating unit 120 (see FIG. 4) sets the first and second transfer signals ϕ1 and ϕ2 to "H." The light-emission signal generating unit 110 (see FIG. 4) sets the light-emission signal ϕI (ϕI1 to ϕI60) to "H."

Then, "H" (0 V) is supplied to the anode terminals of the transfer thyristors T1 to T256 and the light-emitting thyristors L1 to L256 in the light-emitting chip C1, since these anode terminals are connected to the Vsub terminal 86. Meanwhile, the cathode terminals of the transfer thyristors T1 to T256 are connected to either of the first transfer signal ϕ1 or the second transfer signal ϕ2 both of which are set to "H." Accordingly, the anode terminal and the cathode terminal of each of the transfer thyristors T1 to T256 are both set to "H," and thus all the transfer thyristors T1 to T256 are turned off. Similarly, the cathode terminals of the light-emitting thyristors L1 to L256 are connected to the light-emission signal ϕI (the light-emission signal ϕI1 for the light-emitting chip C1) that is set to "H." Accordingly, the anode terminal and the cathode terminal of each of the light-emitting thyristors L1 to L256 are both set to "TH," and thus all the light-emitting thyristors L1 to L256 are turned off.

However, the gate terminals G1 to G256 of the transfer thyristors T and the light-emitting thyristors L are supplied with the power supply potential Vga (−3.3 V) via the resistors R1 to R256, respectively. Accordingly, since connected to the gate terminal G1, the cathode terminal of the start diode Ds is set to −3.3 V. Meanwhile, since connected to the second transfer signal ϕ2 of "H," the anode terminal of the start diode Ds is set to 0 V. Thus, the start diode Ds is forward biased. As a result, with the start diode Ds forward biased, the potential of the gate terminal G1 is set to a value obtained by subtracting the diffusion potential Vd of the pn junction from the potential "H" of the anode terminal of the start diode Ds. For example, when the light-emitting element chips C are formed of GaAs, the diffusion potential Vd is 1.5 V, and thus the potential of the gate terminal G1 is −1.5 V. Next, the gate terminal G2 is connected to the gate terminal G1 via the diode D1. Accordingly, the potential of the gate terminal G2 is set to −3 V of −2Vd. The potentials of the gate terminals G3, . . . , G256 remain −3.3 V, which is the potential of Vga connected thereto via the respective resistors R3, . . . , R256.

The threshold voltage of the transfer thyristor T1 is −3 V, since the potential of the gate terminal G1 of the transfer thyristor T1 is −1.5 V. The threshold voltage of the transfer thyristor T2 is −4.5 V since the potential of the gate terminal G2 is −3 V. The threshold voltage of each of the transfer thyristors T3, T4, . . . , T256 is −4.8 V since the potentials of the gate terminals G3, G4, . . . , G256 are −3.3 V.

Note that, the gate terminals G1, G2, . . . , G256 of the light-emitting thyristors L1, L2, . . . , L256 are connected to the gate terminals G1, G2, . . . , G256 of the transfer thyristors T1, T2, . . . , T256, respectively. Thus, the threshold voltages of the light-emitting thyristors L1, L2, . . . , L256 are the same as those of the transfer thyristors T1, T2, . . . , T256 to which the gate terminals G1, G2, . . . , G256 are connected, respectively.

Next, a description will be given of the period T(L1) during which the light-emitting thyristor L1 is controlled.

At the time point a, the first transfer signal ϕ1 transitions from "H" (0 V) to "L" (−3.3 V). In response, the transfer thyristor T1 whose cathode terminal is connected to the first transfer signal ϕ1 gets turned on, since the threshold voltage thereof is −3 V.

However, the other odd-numbered transfer thyristors T3, T5, . . . , T255 whose cathode terminals are connected to the first transfer signal ϕ1 are not allowed to get turned on, since the threshold voltages thereof are −4.8 V.

That is, at the time point a, it is only the transfer thyristor T1 that is allowed to get turned on.

When the transfer thyristor T1 gets turned on, the potential of the gate terminal G1 rises to "H" (0 V). This makes the diode D1 forward biased, and thus sets the potential of the gate terminal G2 to −1.5 V. As a result, the threshold voltage of the transfer thyristor T2 becomes −3 V.

Meanwhile, upon transition of the first transfer signal ϕ1 to "L," the potential of the gate terminal G1 of the light-emitting thyristor L1 also becomes 0 V. Accordingly, the threshold voltage of the light-emitting thyristor L1 becomes −1.5 V.

Meanwhile, the potential of the gate terminal G2 of the light-emitting thyristor L2 (equal to that of the gate terminal G2 of the transfer thyristor T2) is −1.5 V, and thus the threshold voltage of the light-emitting thyristor L2 is −3 V. The potential of the gate terminal G3 of the light-emitting thyristor L3 is −3 V, and thus the threshold voltage of the light-emitting thyristor L3 is −4.5 V. The potential of the gate terminal G of each of the following light-emitting thyristors L4, L5, . . . , L256 is −3.3 V, and thus the threshold voltage of each of the light-emitting thyristors L4, . . . , L256 is −4.8 V.

Thus, at a time point b, the potential of the light-emission signal ϕI1 is set to a potential between −1.5 V and −3 V so as to be caused only the light-emitting thyristor L1 to emit light. The potential between −1.5 V and −3 V is referred to as "Le," herein.

Then, at a time point c, the potential of the light-emission signal ϕI1 is set back to "H" (0 V). This causes the anode terminal and the cathode terminal of the light-emitting thyristor L1 to have the same potential. Thus, the light-emitting thyristor L1 stops emitting light.

At this time, the first transfer thyristor T1 remains turned on.

Next, a description will be given of the period T(L2) during which the light-emitting thyristor L2 is controlled.

As described above, the threshold voltage of the transfer thyristor T2 is set to −3 V. Accordingly, at the time point d, the second transfer signal ϕ2 is set to "L" (−3.3 V), which turns on the transfer thyristor T2. Once the transfer thyristor T2 gets turned on, the potential of the gate terminal G2 becomes 0 V. Then, the potential of the gate terminal G3 becomes −1.5 V, since the diode D2 is interposed. Thus, the threshold voltage of the transfer thyristor T3 becomes −3 V. Meanwhile, at the time point d, the transfer thyristor T1 remains turned on, and thus the potential of the cathode terminal of the transfer thyristor T1 is −1.5 V, which is the diffusion potential Vd of the pn junction. Here, the cathode terminals of the respective transfer thyristors T1 and T3 are connected to the first transfer signal line 72. Accordingly, the potential of the first transfer signal line 72 is fixed to −1.5 V, and thus the transfer thyristor T3 does not get turned on.

Note that when the transfer thyristor T2 gets turned on, the potential of the gate terminal G2 becomes to 0 V, which sets the threshold voltage of the light-emitting thyristor L2 to −1.5 V.

Then, at a time point e, the first transfer signal (pi is set to "H." This sets both the anode terminal and the cathode terminal of the transfer thyristor T1 to "H." Thus, the transfer thyristor T1 is no longer kept turned on, and thus gets turned off.

Meanwhile, when the transfer thyristor T1 gets turned off, the potential of the gate terminal G1 drops from, "H" (0 V) to "L" of the Vga potential (−3.3 V). At this time, the potential of the gate terminal G2 is set to "H" (0 V). Accordingly, the diode D1 gets reverse biased, and thus the effect of the potential change (from −1.5 V to 0 V) of the gate terminal G2 is not transmitted to the gate terminal G1.

Note that the transfer thyristors T1 and T2 are both turned on during a period from the time point d to the time point e.

Thus, at a time point f, the light-emission signal ϕI1 is set to "Le" (the potential between −1.5 V and −3 V). This causes only the light-emitting thyristor L2 to emit light, and the other light-emitting thyristors L1, L3, L4, . . . not to emit light. At this time, the transfer thyristor T2 remains turned on.

Then, at a time point g, the light-emission signal ϕI1 is set to "H." This sets both the anode terminal and the cathode terminal of the light-emitting thyristor L2 to "H." Accordingly, the light-emitting thyristor L2 is disabled to continue to emit light any longer, and thus stops emitting light. At this time point, the transfer thyristor T2 remains turned on.

Next, a description will be given of the period T(L3) during which the light-emitting thyristor L3 is controlled.

At the time point h, the first transfer signal ϕ1 is set to "L" (−3.3 V). In response, the transfer thyristor T3 gets turned on, and thus the potential of the gate terminal G3 of the transfer thyristor T3 becomes 0 V. Then, the gate terminal G4 becomes −1.5 V, since the diode D3 is interposed. At this time, the transfer thyristors T2 and T3 are both turned on.

Then, at the time point i, the second transfer signal ϕ2 is set to "H." This set both the anode terminal and the cathode terminal of the transfer thyristor T2 to have the same potential of "H." Thus, the transfer thyristor T2 is no longer kept turned on, and thus gets turned off.

At this time, the threshold voltage of the light-emitting thyristor L3 is −1.5 V since the potential of the gate terminal G3 is 0 V. Accordingly, at the time point j, the light-emission signal ϕI1 is set to "Le." This causes the light-emitting thyristor L3 to emit light. Thereafter, at the time point k, the light-emission signal ϕI1 is set to "H." In response, the light-emitting thyristor L3 stops emitting light.

After that, in the period T(L4) starting at the time point 1, the same operation as that in the period T(L2) starting at the time point d is performed.

As described above, when one of the transfer thyristors T gets turned on in response to one of the paired transfer signals (the first transfer signal ϕ1 or the second transfer signal ϕ2), the potential of the gate terminal G thereof becomes 0 V. This causes the diode D connected to the transfer thyristor T to be forward biased, and thus changes the potential of the gate terminal G of another one (which is assigned a number larger by one than the transfer thyristor T) of the transfer thyristors T that is connected to the diode D. As a result, the absolute value of the threshold voltage of the latter transfer thyristor T is lowered. Then, the other one of the paired transfer signals (the first transfer signal ϕ1 or the second transfer signal ϕ2) turns on the latter transfer thyristor T.

That is, by using the first and second transfer signals $\phi$1 and $\phi$2, the turned-on state is propagated (transferred) among the transfer thyristors T in the ascending numerical order.

Meanwhile, along with the change in the potential of the gate terminal G of each transfer thyristor T, the absolute value of the threshold voltage of the light-emitting thyristor L connected to the gate terminal G is lowered. Accordingly, the light-emission and non-light-emission of the light-emitting thyristor L are controllable based on image data, by setting the light-emission signal $\phi$I to "Le," which leads to "light-emission (emitting light)," or by keeping the light-emission signal $\phi$I at "H," which leads to "non-light-emission."

Hereinbefore, the operation of the light-emitting chip C1 has been described. As described above, the light-emitting chips C (C1 to C60) constituting the light-emitting portion 63 are driven in parallel, by using the first and second transfer signals $\phi$1 and $\phi$2 supplied in common to the light-emitting chips C (C1 to C60). In synchronization with the first and second transfer signals $\phi$1 and $\phi$2 supplied in common, the light-emission signals $\phi$I ($\phi$I1 to $\phi$I60) based on image data are transmitted to the respective light-emitting chips C (C1 to C60). That is, the light-emitting chips C (C1 to C60) in the light-emitting portion 63 performs the same operation as the light-emitting chip C1 does as described above.

Example

Hereinafter, a description will be given of changes in light-emission amount with changes in temperature calculated using simulations in Example and Comparative Examples.

Example

A light-emitting thyristor L of Example has a structure shown in FIG. 7. Here, the distributed Bragg reflection layer 81 is formed by stacking 20 pairs of two types of AlGaAs layers having mutually different Al concentrations. The thickness of the distributed Bragg reflection layer 81 is 1 μm. The pnpn structure of the semiconductor layer 60 (the p-type first semiconductor layer 82, the n-type second semiconductor layer 83, the p-type third semiconductor layer 84 and the n-type fourth semiconductor layer 85) is made of GaAs.

The distance la between the equivalent reflecting surface 152 and (the surface of) each convex portion 88 of the uneven semiconductor layer surface 91 of the semiconductor layer 60 is 3.05 μm. The distance lb between the equivalent reflecting surface 152 and (the surface of) each concave portion 89 of the uneven semiconductor layer surface 91 is 3.00 μm. The difference Δ(la−lb) between the distances la and lb is 50 nm.

Both the widths wa and wb respectively of each convex portion 88 and each concave portion 89 of the uneven semiconductor layer surface 91 are 2 μm. The areas respectively of the convex portion 88 and the concave portion 89 are set so that the light intensity extracted from the convex portion 88 is equal to that extracted from the concave portion 89.

The center wavelength of light emitted by the light-emitting thyristor L is 780 nm. The distributed Bragg reflection layer 81 is configured to uniformly reflect approximately 100% of light beams whose wavelengths range from 720 nm to 830 nm.

The light beams generated from the light-emitting region 151 behave as described above.

Comparative Examples

Figure 9B:
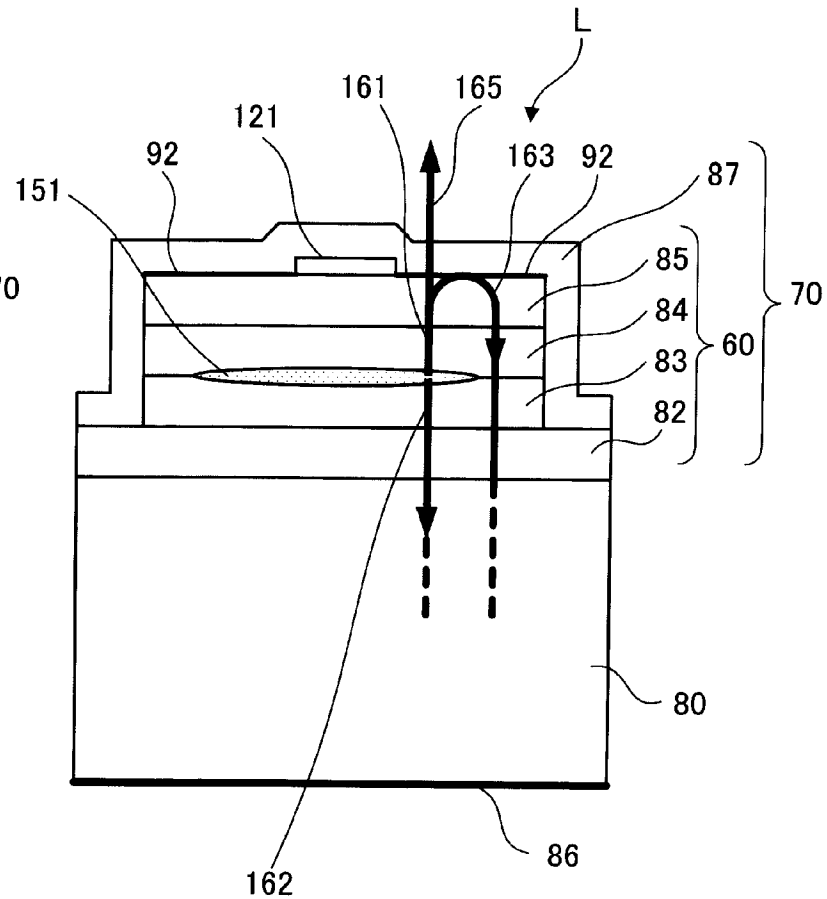
FIGS. 9A and 9B are diagrams for illustrating a structure of a light-emitting thyristor of each of Comparative Examples.
Figure 9A:
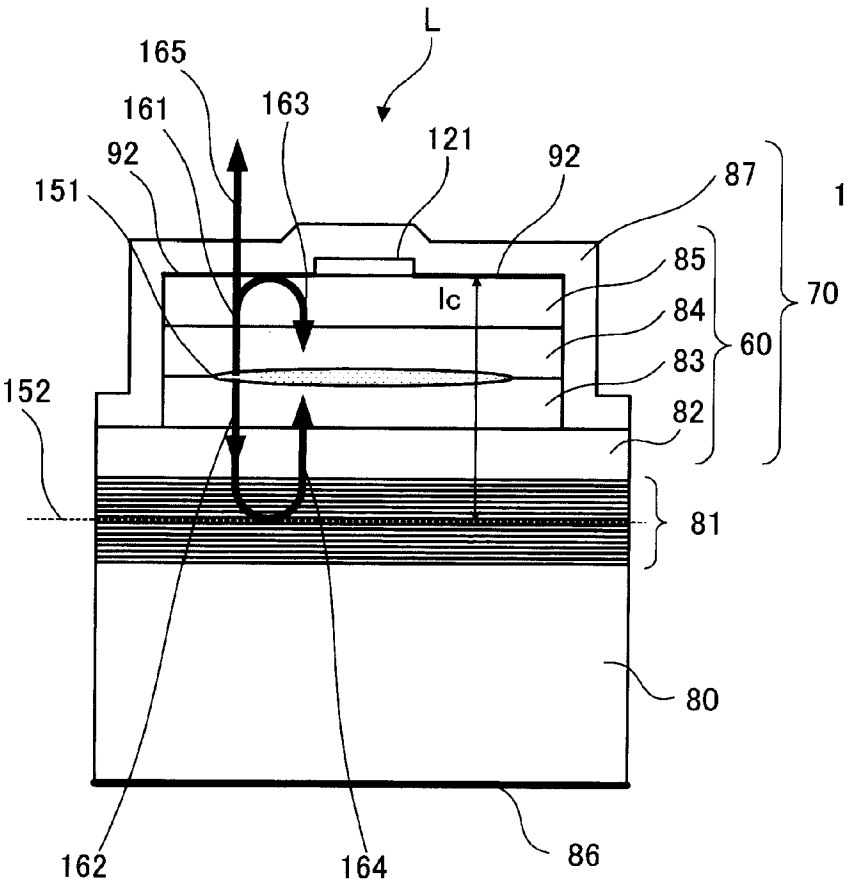

FIG. 9A is a diagram for illustrating a structure of a light-emitting thyristor L of each of Comparative Examples (Comparative Examples 1 and 2).

The light-emitting thyristors L of Comparative Examples 1 and 2 are different from that of Example in that the surface of the semiconductor layer 60 has no unevenness, and is an even semiconductor layer surface 92. Except for that point, the light-emitting thyristors L of Comparative Examples have the same configuration as the light-emitting thyristor L of Example does. Specifically, regions, not provided with the ohmic electrodes 121, of the surface of the semiconductor layer 60 opposite to the substrate 80 (the regions, indicated by the bold line in FIG. 9A, of the surface of the fourth semiconductor layer 85) will be referred to as the even semiconductor layer surface 92.

Here, Comparative Example 1 is the light-emitting thyristor L in which the distance lc between the even semiconductor layer surface 92 and the equivalent reflecting surface 152 is set to 3.00 μm, while Comparative Example 2 is the light-emitting thyristor L in which the distance lc is set to 3.05 μm. That is, the difference in the distance lc between Comparative Examples 1 and 2 is 50 nm.

The light beams generated from the light-emitting region 151 in each of Comparative Examples behave as in Example.

FIG. 9B is a diagram for illustrating a structure of a light-emitting thyristor L of Comparative Example 3.

The light-emitting thyristor L of Comparative Example 3 is different from that of Example in that the surface of the semiconductor layer 60 is the even semiconductor layer surface 92, and that the distributed Bragg reflection layer 81 is not provided therein. Except for these points, the light-emitting thyristor L of Comparative Example 3 have the same configuration as the light-emitting thyristor L of Example does.

In the light-emitting thyristor L of Comparative Example 3, some of light beams generated from the light-emitting region 151 travel toward the even semiconductor layer surface 92 as the light beams 161, and others travel toward the substrate 80 as the light beams 162. Some of the light beams 161 traveling toward the semiconductor layer surface 92 are emitted outside from the semiconductor layer surface 92 as the light beams 165, and others are reflected by the semiconductor layer surface 92, and thus travel toward the substrate 80 as the light beams 163. Meanwhile, the light beams 162 traveling toward the substrate 80 (including the light beams 163 traveling toward the substrate 80 after reflected by the semiconductor layer surface 92) are absorbed by the substrate 80, and thus are not emitted outside from the semiconductor layer surface 92.

Note that some of the light beams 165 emitted outside from the semiconductor layer surface 92 are reflected by the interface between the protective film layer 87 and the air, and thus travel toward the substrate 80. However, these light beams are also absorbed by the substrate 80.

(Temperature Dependencies of Light-Emission Amount Change)

Figure 10:
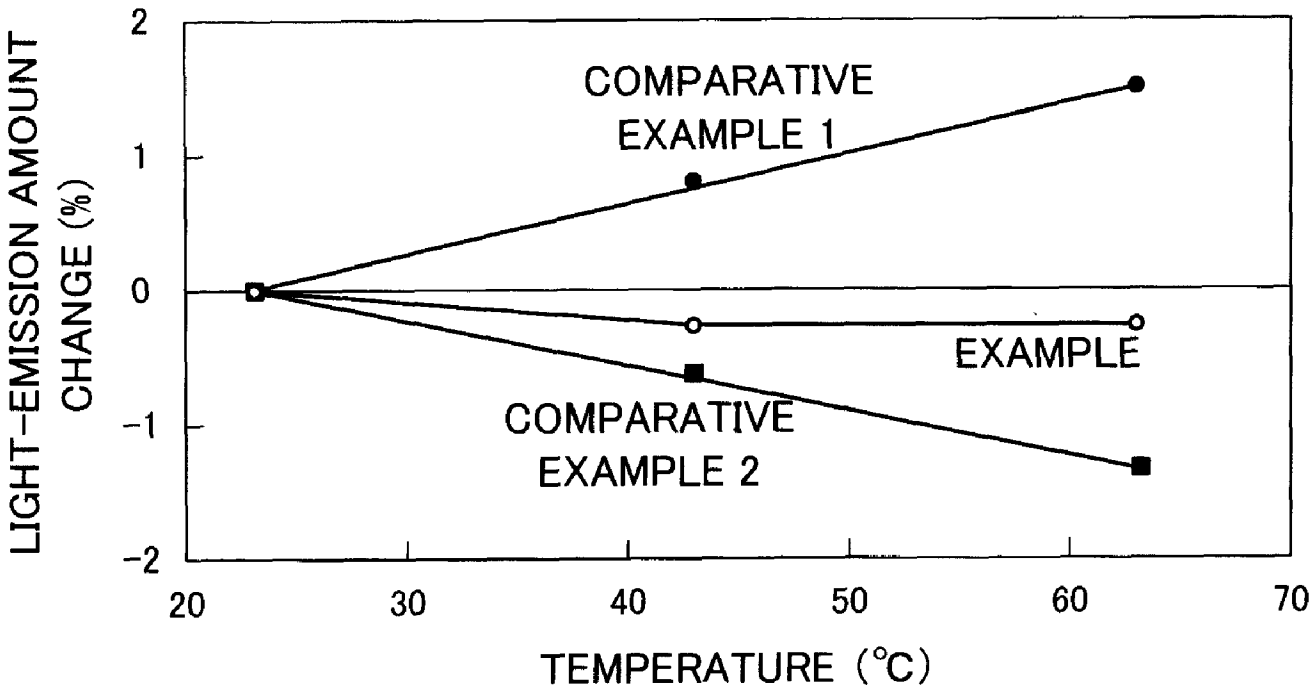
FIG. 10 is a graph for illustrating relation between light-emission amount change (%) and temperature of Example and Comparative Examples 1 and 2.

FIG. 10 is a graph for illustrating a relation between light-emission amount change (%) and temperature of Example and Comparative Examples 1 and 2.

In FIG. 10, the vertical axis represents light-emission amount change expressed as a percentage (%) based on the light-emission amount at 23 degrees C., while the horizontal axis represents a temperature. The light-emission amount change (%) at 23 degrees C. is 0 in Example and Comparative Examples 1 and 2.

In Example, the light-emission amount change caused by a temperature change from 23 degrees C. to 63 degrees C. is −0.27%. By contrast, in Comparative Examples 1 and 2, the light-emission amount changes caused by the same temperature change are 1.55% and −1.44%, respectively.

The direction of light-emission amount change caused by temperature change is inverted between Comparative Examples 1 and 2. Specifically, the light-emission amount increases as the temperature rises in Comparative Example 1, but decreases as the temperature rises in Comparative Example 2. In addition, the light-emission amount change in each of Comparative Examples 1 and 2 is more than five times as large as that in Example.

Hereinafter, a description will be given of reasons why the direction of light-emission amount change caused by temperature change is inverted between Comparative Examples 1 and 2 and why the light-emission amount change in each of Comparative Examples 1 and 2 is more than five times as large as that in Example.

Firstly, the light extraction efficiency of the light-emitting thyristor L will be described. Then, temperature characteristics of light-emission spectrums of the light-emitting thyristor L will be described. Thereafter, temperature characteristics of light-emission amount of the light-emitting thyristor L will be described.

(Light Extraction Efficiency)

Firstly, the light extraction efficiency of the light-emitting thyristor L calculated using simulations will be described. The light extraction efficiency is expressed as a light-emission spectrum under the assumption that the light-emitting thyristor L emits light with a constant intensity over all wavelengths. This allows exclusive extraction of effects of reflections by the distributed Bragg reflection layer 81 and the semiconductor layer surfaces 91 and 92.

Figure 11A:
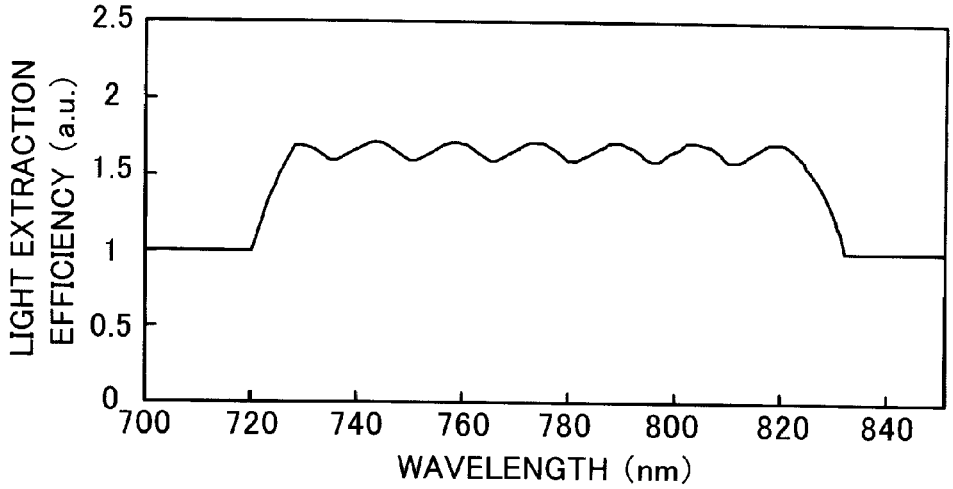
FIGS. 11A to 11C are graphs for illustrating the light extraction efficiency of Example, and Comparative Examples 1 and 2.
Figure 11B:
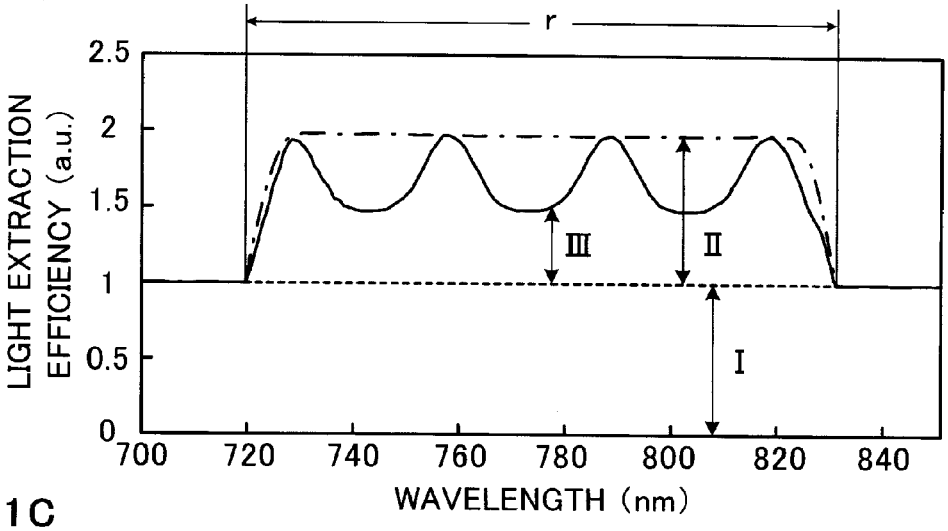
Figure 11C:
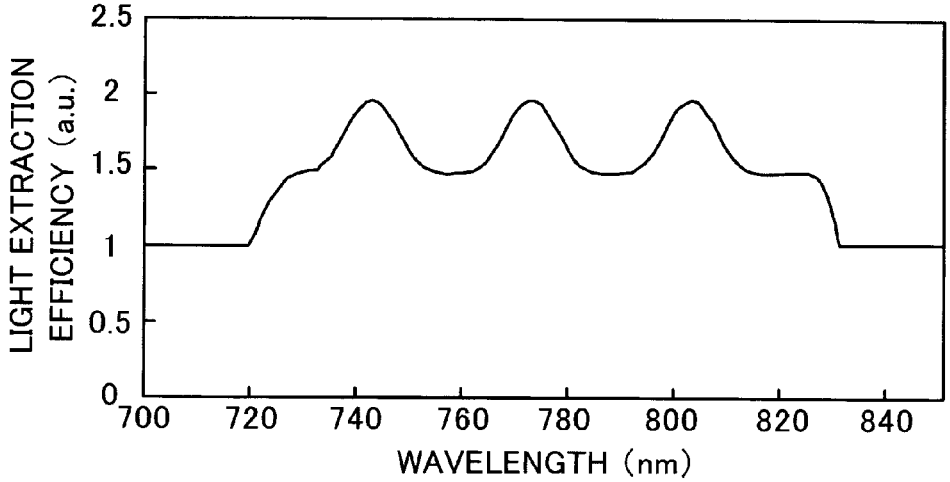

FIGS. 11A to 11C are graphs for illustrating the light extraction efficiency of Example, and Comparative Examples 1 and 2. FIGS. 11A to 11C correspond to Example, Comparative Example 1 and Comparative Example 2, respectively. The vertical and horizontal axes of each graph represent light extraction efficiency expressed in an arbitrary unit (a.u.) and a wavelength (range: 700 nm to 850 nm), respectively.

The light extraction efficiency from the light-emitting thyristor L will be described by using the light extraction efficiency of Comparative Example 1 shown in FIG. 11B.

Some of light beams generated from the light-emitting region 151 in the light-emitting thyristor L travel toward the semiconductor layer surface 92 as the light beams 161, and others travel toward the distributed Bragg reflection layer 81 as the light beams 162.

Some of the light beams 161 traveling toward the semiconductor layer surface 92 continue traveling to be emitted outside through the protective film layer 87 as the light beams 165. Here, since the light-emitting thyristor L is assumed to emit light with a constant intensity over all wavelengths, the light extraction efficiency does not depend on wavelengths. This light extraction efficiency corresponds to the portion indicated by I in FIG. 11B.

Next, among the light beams generated in the light-emitting thyristor L, the light beams 162 traveling toward the distributed Bragg reflection layer 81 are reflected by the distributed Bragg reflection layer 81. The distributed Bragg reflection layer 81 reflects 100% of light beams whose wavelengths range from 720 nm to 830 nm (in a wavelength band r). If the reflection by the semiconductor layer surface 92 is left out of consideration, all these reflected light beams will be emitted outside of the light-emitting thyristor L. Then, the light extraction efficiency of these light beams corresponds to the portion indicated by II in the wavelength band r in FIG. 11B.

However, among the light beams generated from the light-emitting region 151 in the light-emitting thyristor L, some of the light beams 161 traveling toward the semiconductor layer surface 92 are reflected by the semiconductor layer surface 92 (the interface between the fourth semiconductor layer 85 and the protective film layer 87) and by the interface between the protective film layer 87 and the air.

Here, since the fourth semiconductor layer 85 is made of GaAs (having a refractive index $u_1$ of 3.55 for light having a wavelength of 780 nm) and the protective film layer 87 is made of $SiO_2$ (having a refractive index $u_2$ of 1.45 for light having a wavelength of 780 nm), the reflectance of the semiconductor layer surface 92 (the interface between the fourth semiconductor layer 85 and the protective film layer 87) for light having a wavelength of 780 nm is 18%. Meanwhile, the reflectance of the interface between the protective film layer 87 and the air (having a refractive index of 1) for light having a wavelength of 780 nm is 3.4%. In the description for the present exemplary embodiment, only the reflection by the semiconductor layer surface 92 (interface between the fourth semiconductor layer 85 and the protective film layer 87) having a higher reflectance is taken into consideration, for ease of understanding.

Accordingly, 18% of the light beams 161 traveling toward the semiconductor layer surface 92 are reflected by the semiconductor layer surface 92, and thus travel toward the distributed Bragg reflection layer 81 as the light beams 163.

Meanwhile, among the light beams generated from the light-emitting region 151 in the light-emitting thyristor L, 100% of the light beams 162 traveling toward the distributed Bragg reflection layer 81 are reflected by the distributed Bragg reflection layer 81, and thus travel toward the semiconductor layer surface 92 as the light beams 164.

As a result, interference occurs between the light beams 163 traveling toward the distributed Bragg reflection layer 81 after reflected by the semiconductor layer surface 92 and the light beams 164 traveling toward the semiconductor layer surface 92 after reflected by the distributed Bragg reflection layer 81.

Specifically, if crests and troughs of a light wave coincide with crests and troughs of another light wave, respectively, the two light waves interfere constructively. If crests and troughs of a light wave coincide with troughs and crests of another light wave, respectively, the two light waves interfere destructively. Light waves having a wavelength causing destructive interference are not emitted out of the light-emitting thyristor L.

In Comparative Example 1, the distance lc between the equivalent reflecting surface 152 and the semiconductor layer surface 92 is set to 3 μm. This distance lc (3 μm) is far larger than the wavelengths (from 720 nm to 830 nm) reflected by the distributed Bragg reflection layer 81. Accordingly, standing waves (light waves each formed by interference of light waves in phase) are formed for multiple wavelengths.

The wavelengths of the standing waves are the wavelengths λ each satisfying the relation that the distance lc is the integral multiple of $\lambda/(2\times u_1)$ ($u_1$ is the refractive index of the semiconductor layer 60). The refractive index $u_1$ of the semiconductor layer 60 made of GaAs is 3.55 for light having a wavelength around 780 nm. Thus, for four wavelengths (734 nm, 761 nm, 789 nm and 819 nm), the standing waves are formed in the wavelength band from 720 nm to 830 nm. The wavelength intervals between the standing waves range from 27 nm to 30 nm.

That is, the light beams having wavelengths of the standing waves do not cancel out, and thus are emitted from the semiconductor layer surface 92. On the other hand, the light beams having wavelengths in the wavelength intervals of the standing waves cancel out, and thus are not emitted from the semiconductor layer surface 92.

Thus, the light extraction efficiency of the light beams reflected by the distributed Bragg reflection layer 81 corresponds not to the portion indicated by II, but to the portion indicated by III in FIG. 11B. That is, the light extraction efficiency takes maximum values (forms peaks) for the four wavelengths (734 nm, 761 nm, 789 nm and 819 nm) and is lowered for the wavelengths therebetween. In other words, the light extraction efficiency of the light-emitting thyristor L of Comparative Example 1 is wavelength dependent.

FIG. 11C is a graph for illustrating the light extraction efficiency of the light-emitting thyristor L of Comparative Example 2. In Comparative Example 2, the distance lc between the equivalent reflecting surface 152 and the semiconductor layer surface 92 is set to 3.05 μm. In other words, the distance lc in Comparative Example 2 is 50 nm larger than that in Comparative Example 1. Thus, for three wavelengths (747 nm, 774 nm and 802 nm) the standing waves are formed in the wavelength band from 720 nm to 830 nm. The light extraction efficiency takes maximum values (forms peaks) for these wavelengths. Note that the wavelength intervals between peaks in wavelengths, which form the standing waves, range from 27 nm to 28 nm. Accordingly, the light extraction efficiency of the light-emitting thyristor L of Comparative Example 2 is also wavelength dependent.

The wavelengths of the standing waves shift by 13 nm to 17 nm between Comparative Examples 1 and 2. The shift value is approximately half of the wavelength intervals of 27 nm to 30 nm between the standing waves in Comparative Examples 1 and 2. As a result, the wavelengths forming the standing waves in Comparative Example 2 are positioned between the wavelengths forming the standing waves in Comparative Example 1.

FIG. 11A is a graph for illustrating the light extraction efficiency of the light-emitting thyristor L of Example. In the light-emitting thyristor L of Example, the distance la from the equivalent reflecting surface 152 to each convex portion 88 of the semiconductor layer surface 91 is 3.05 μm, while the distance lb from the equivalent reflecting surface 152 to each concave portion 89 thereof is 3.00 μm. Accordingly, the light extraction efficiency is expressed as a light-emission spectrum obtained by adding the light-emission spectrum in Comparative Example 1 shown in FIG. 11B to the light-emission spectrum in Comparative Example 2 shown in FIG. 11C. That is, the light extraction efficiency of the light-emitting thyristor L of Example is expressed as a light-emission spectrum obtained by placing the crests (peaks) of the light extraction efficiency in Comparative Example 2 shown in FIG. 11C in the intervals between the crests (peaks) of the light extraction efficiency in Comparative Example 1 shown in FIG. 11B.

As described above, in Example, the areas respectively of each convex portion 88 and each concave portion 89 of the semiconductor layer surface 91 are set so that the light intensity extracted from the convex portion 88 is equal to that extracted from the concave portion 89. As a result, the crests (peaks) of the light extraction efficiency of Comparative Example 1 are approximately as high as those of Comparative Example 2. Therefore, the light extraction efficiency of the light-emitting thyristor L of Example is less wavelength dependent in the wavelength band from 720 nm to 830 nm, which is the reflection wavelength band of the distributed Bragg reflection layer 81.

(Light-Emission Spectrum of Light-Emitting Thyristor L)

Then, a description will be given of the spectrum (light-emission spectrum) of light beams emitted from the light-emitting region 151 in the light-emitting thyristor L.

Figure 12:
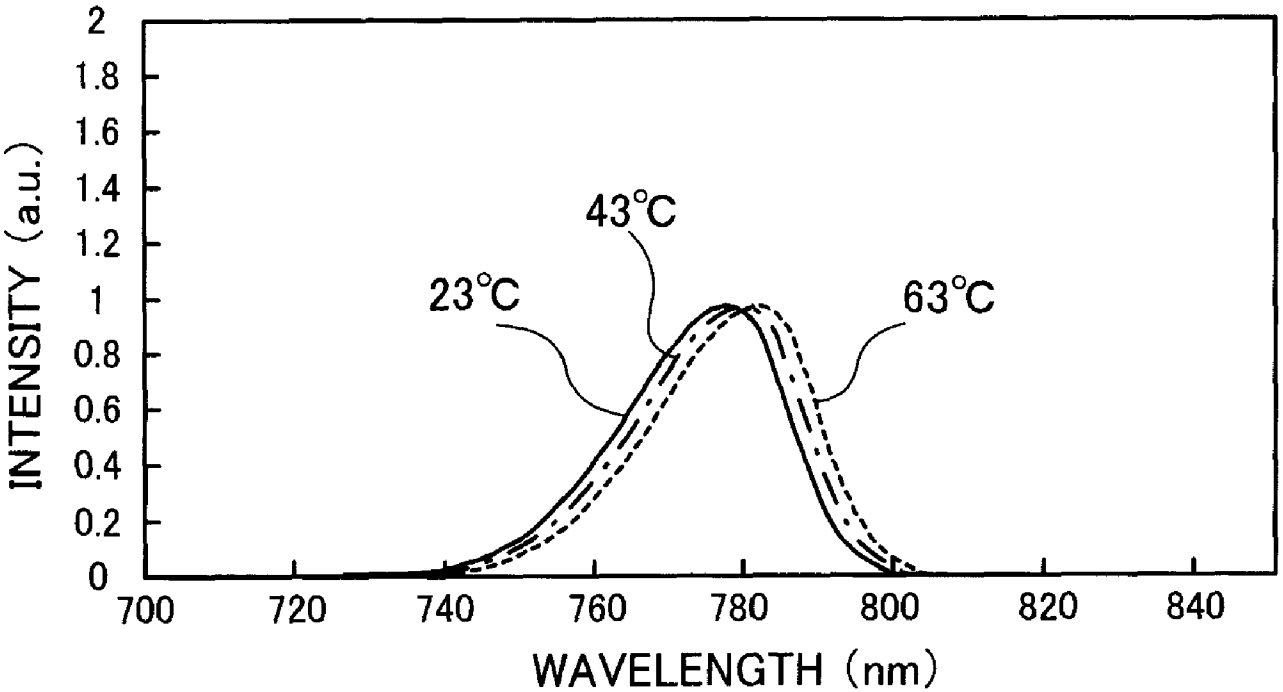
FIG. 12 is a graph showing changes in the light-emission spectrum of the light-emitting thyristor with changes in temperature.

FIG. 12 is a graph illustrating the light-emission spectrums of the light-emitting thyristor L of Comparative Example 3. In FIG. 12, the vertical and horizontal axes represent light intensity expressed in an arbitrary unit (a.u.) and light wavelength (700 nm to 850 nm), respectively. Hereinafter, the light-emission spectrums are shown in the same manner.

As shown in FIG. 9B, the light-emitting thyristor L of Comparative Example 3 does not have the distributed Bragg reflection layer 81. Accordingly, among the light beams emitted from the light-emitting region 151, the light beams 162 traveling toward the substrate 80 are absorbed by the substrate 80, and thus do not travel back to the semiconductor layer surface 92. Among the light beams 161 traveling toward the semiconductor layer surface 92, the light beams reflected by the semiconductor layer surface 92 (interface between the semiconductor layer 60 and the protective film layer 87) and the interface between the protective film layer 87 and the air do not travel back to the semiconductor layer surface 92 either. That is, no light interference occurs in the light-emitting thyristor L of Comparative Example 3. Accordingly, the light-emission spectrum of light emitted by the light-emitting thyristor L in Comparative Example 3 is the same as that of light generated from the light-emitting region 151.

FIG. 12 shows the light-emission spectrums of the light-emitting thyristor L of Comparative Example 3 at 23 degrees C., 43 degrees C. and 63 degrees C., respectively. The intensity of light-emission spectrum at 23 degrees C. reaches its peak when the wavelength is 780 nm. The light-emitting thyristor L emits light having wavelengths ranging from 740 nm to 800 nm (the emission wavelength band). In the light-emission spectrum, the portion of wavelengths from 740 nm to the peak wavelength of 780 nm is wider than that of wavelengths from the peak wavelength of 780 nm to 800 nm. In other words, with respect to the peak intensity, the long-wavelength side is narrower and the short-wavelength side is wider.

Note that the emission wavelength band (from 740 nm to 800 nm in wavelength) of the light-emitting thyristor L of Comparative Example 3 overlaps the wavelength band (from 720 nm to 830 nm) of light reflected by the distributed Bragg reflection layer 81.

As temperature rises to 43 degrees C. and to 63 degrees C., the light-emission spectrum shifts to the long-wavelength side while maintaining the form constant. This is because, as temperature rises, the bandgap of a semiconductor such as GaAs becomes narrower, which causes the emission wavelengths to shift to the long-wavelength side. The wavelength change has a temperature coefficient of 0.2 nm/degrees C.

Note that the light-emission spectrum of the light-emitting thyristor L of Comparative Example 3 shifts with temperature change in the same manner among the light-emitting chips C.

Next, a description will be given of the light-emission spectrum of the light-emitting thyristor L provided with the distributed Bragg reflection layer 81 (Example shown in FIG. 7 and Comparative Examples 1 and 2 shown in FIG. 9A).

The light extraction efficiency described above is expressed as a light-emission spectrum under the assumption that the light-emitting thyristor L emits light with a constant intensity over all wavelengths.

Thus, the light-emission spectrums of the light-emitting thyristor L provided with the distributed Bragg reflection layer 81 may be obtained by multiplying the light extraction efficiency (FIGS. 11A to 11C) of Example and Comparative Examples 1 and 2 by the light-emission spectrums shown in FIG. 12.

Note that changes in the light-emitting thyristor L with temperature change include structural change due to thermal expansion in addition to the aforementioned bandgap change. However, since a semiconductor such as GaAs has a small thermal expansion coefficient, the temperature change will not cause large changes in the structure of the distributed Bragg reflection layer 81 or in the distances la and lb respectively from each convex portion 88 and each concave portion 89 to the equivalent reflecting surface 152. Accordingly, changes in the reflection wavelengths of the distributed Bragg reflection layer 81 and the distances la and lb with temperature change are left out of consideration herein.

Figure 13:
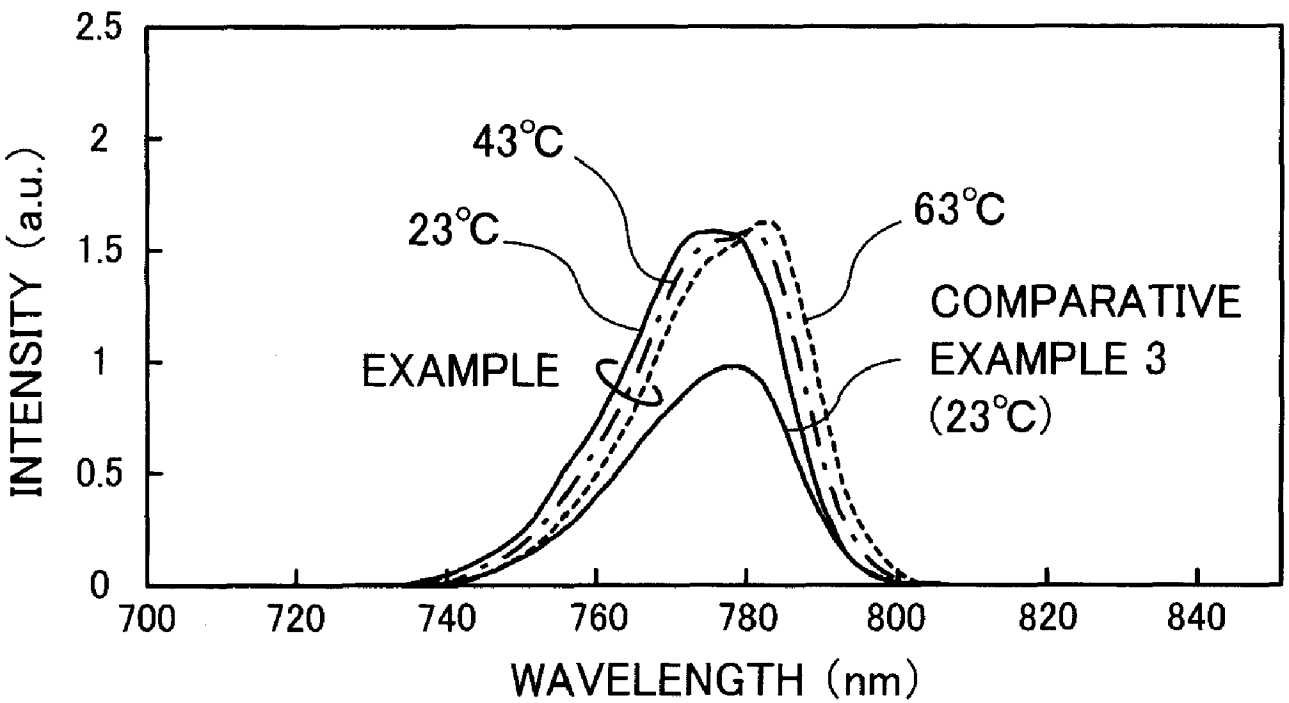
FIG. 13 is a graph for illustrating changes in the light-emission spectrum of the light-emitting thyristor of Example with changes in temperature.

FIG. 13 is a graph for illustrating changes in the light-emission spectrum of the light-emitting thyristor L of Example with changes in temperature. The light-emission spectrums in FIG. 13 are obtained by multiplying the light extraction efficiency of Example shown in FIG. 11A by the light-emission spectrums of the light-emitting thyristor L of Comparative Example 3 shown in FIG. 12. Note that FIG. 13 also shows the light-emission spectrum of Comparative Example 3 at 23 degrees C., for comparison.

The intensity at the peak wavelength of 780 nm in the light-emission spectrum of the light-emitting thyristor L of Example (at 23 degrees C.) is higher than that in the light-emission spectrum of Comparative Example 3 (at 23 degrees C.). This is because, in the light-emitting thyristor L of Example, the light beams 162 traveling toward the substrate 80 are reflected by the distributed Bragg reflection layer 81, and thus contribute to increasing light output. That is, the light-emitting thyristor L with the distributed Bragg reflection layer 81 therein is increased in light use efficiency and in light intensity.

Meanwhile, in terms of the forms of the light-emission spectrums, Example is similar to Comparative Example 3 shown in FIG. 12. As temperature rises to 43 degrees C. and to 63 degrees C., the light-emission spectrum of the light-emitting thyristor L of Example shifts to the long-wavelength side while substantially maintaining the form at 23 degrees C. This is because the forms of the light-emission spectrums of Example more closely reflect those of Comparative Example 3 shown in FIG. 12 since the light extraction efficiency of the light-emitting thyristor L of Example is less wavelength dependent as shown in FIG. 11A.

Figure 14:
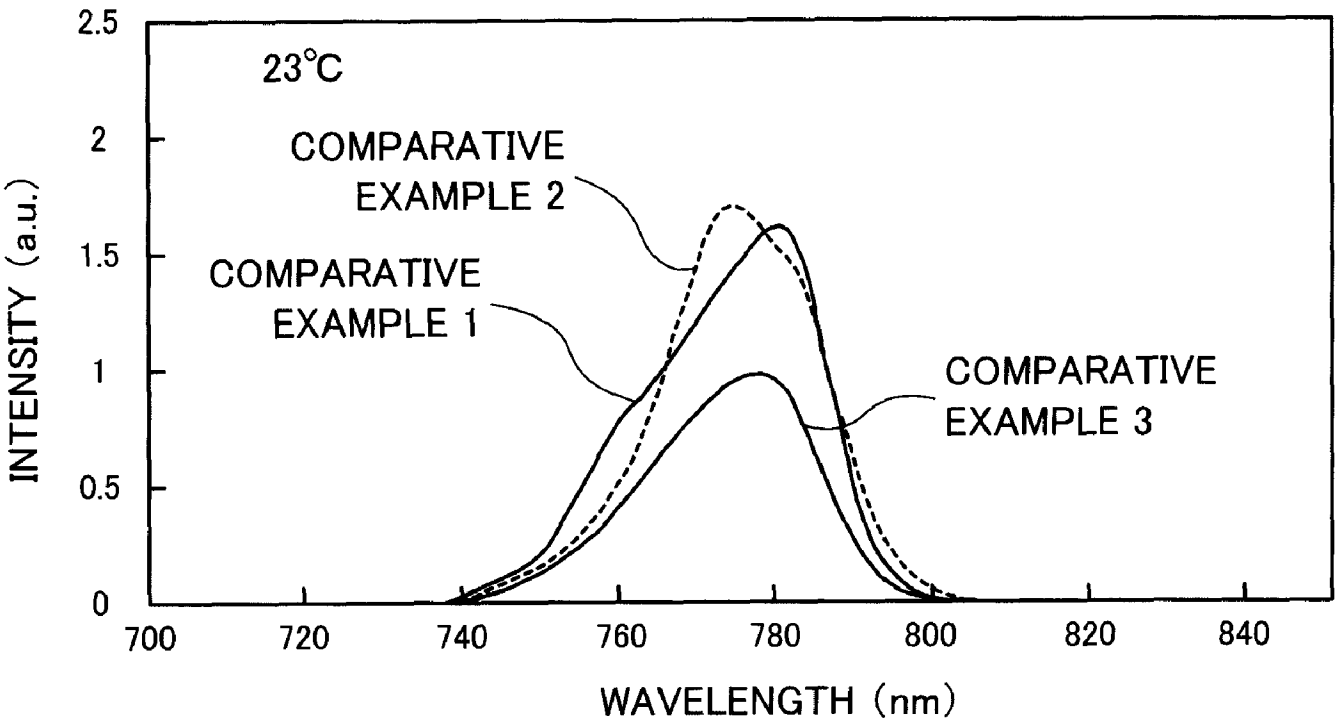
FIG. 14 is a graph for illustrating the light-emission spectrums at 23 degrees C. of the light-emitting thyristors of Comparative Examples 1 to 3, respectively.

FIG. 14 is a graph for illustrating the light-emission spectrums at 23 degrees C. of the light-emitting thyristors L of Comparative Examples 1 to 3, respectively.

The light-emission spectrum of Comparative Example 1 is obtained by multiplying the light-emission spectrums shown in FIG. 12 by the light extraction efficiency shown in FIG. 11B. Similarly, the light-emission spectrum of Comparative Example 2 is obtained by multiplying the light-emission spectrums shown in FIG. 12 by the light extraction efficiency shown in FIG. 11C.

The peak intensity in the light-emission spectrum of each of Comparative Examples 1 and 2 is higher than that in the light-emission spectrum of Comparative Example 3. This is because, as in the light-emitting thyristor L of Example, the light beams 162 traveling toward the substrate 80 are reflected by the distributed Bragg reflection layer 81, and thus contribute to increasing light output.

Meanwhile, Comparative Examples 1 and 2 are different from each other in the form of the light-emission spectrum of light-emitting thyristor L. This is because as shown in FIGS. 11B and 11C, the light extraction efficiency of Comparative Examples 1 and 2 is wavelength dependent, and reaches their peaks at mutually different wavelengths.

Figure 15:
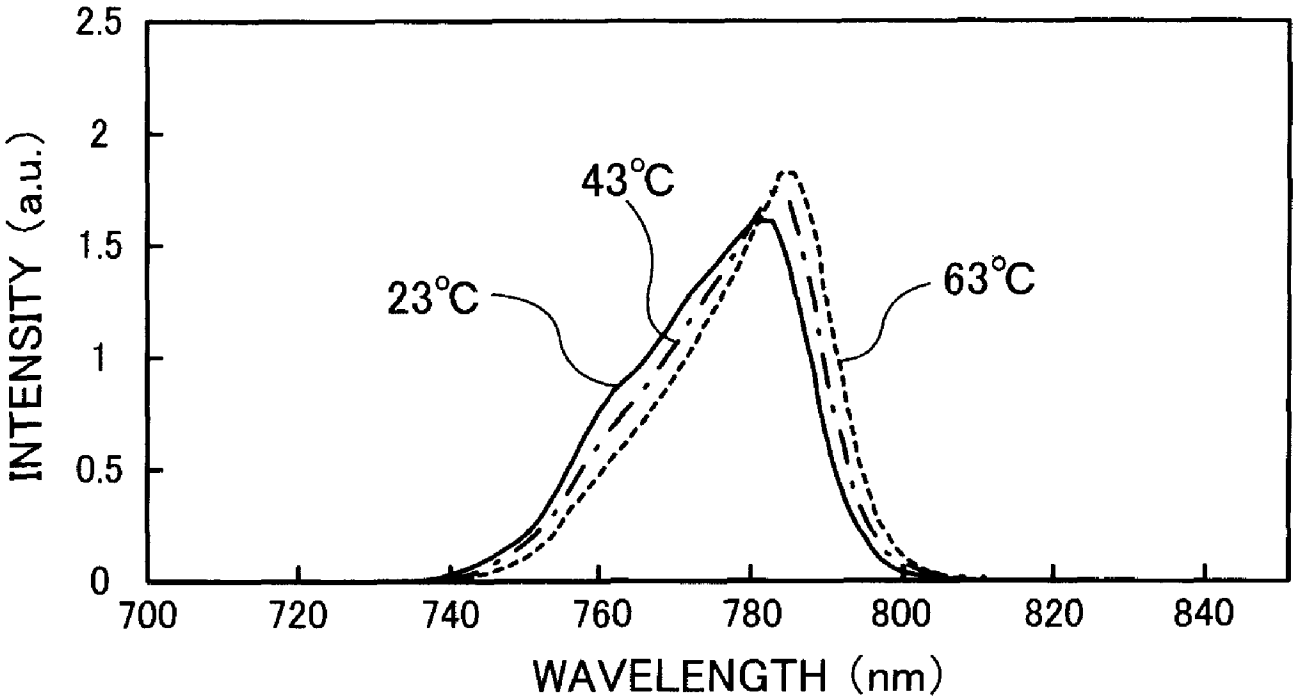
FIG. 15 is a graph for illustrating changes in the light-emission spectrum of the light-emitting thyristor of Comparative Example 1 with changes in temperature.

FIG. 15 is a graph for illustrating changes in the light-emission spectrum of the light-emitting thyristor L of Comparative Example 1 with changes in temperature. As temperature rises, the intensity at 765 nm decreases while the intensity at 785 nm increases in the light-emission spectrum.

Figure 16:
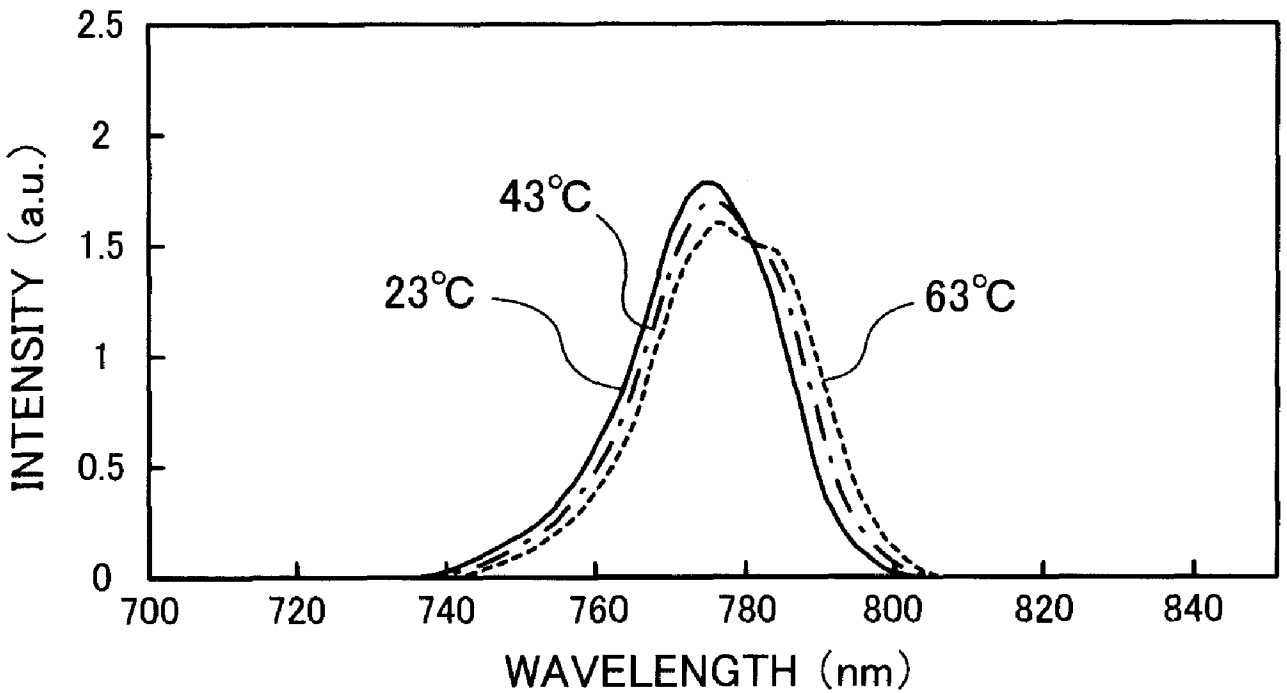
FIG. 16 is a graph for illustrating changes in the light-emission spectrum of the light-emitting thyristor of Comparative Example 2 with changes in temperature.

FIG. 16 is a graph for illustrating changes in the light-emission spectrum of the light-emitting thyristor L of Comparative Example 2 with changes in temperature. As temperature rises, the waveform of the light-emission spectrum shifts to the long-wavelength side, and the peak intensity at 775 nm decreases in the light-emission spectrum.

Next, referring back to FIG. 10, a description will be given of the temperature dependencies of the light-emission amounts of the light-emitting thyristors L in Example and Comparative Examples 1 and 2, respectively.

Each of the light-emission amounts of the light-emitting thyristors L of Example, and Comparative Examples 1 and 2 shown in FIG. 10 is obtained by summing up, in the entire emission wavelength band, the light-emission spectrums shown in FIG. 13, 15 or 16, respectively.

As shown in FIG. 10, the light-emission amount of the light-emitting thyristor L of Example, which is obtained by summing up the light-emission spectrums (FIG. 13) in the entire emission wavelength band, changes little with temperature change.

Meanwhile, as shown in FIG. 10, the light-emission amount of the light-emitting thyristor L of Comparative Example 1, which is obtained by summing up the light-emission spectrums (FIG. 15) in the entire emission wavelength band, increases as temperature rises. As shown in FIG. 10, the light-emission amount of the light-emitting thyristor L of Comparative Example 2, which is obtained by summing up the light-emission spectrums (FIG. 16) in the entire emission wavelength band, decreases as temperature rises.

The reason why these differences appear is, as shown in FIGS. 11B and 11C, that the light extraction efficiency of the light-emitting thyristors L of Comparative Examples 1 and 2 is both wavelength dependent, and reaches their peaks at mutually different wavelengths. As a result, Comparative Examples 1 and 2 are considered to be different from each other in extracted wavelengths and thus in temperature dependencies.

Incidentally, the image forming apparatus 1 is required to be capable of forming images whose image qualities are less dependent on temperature. Thus, the light-emission amount of each light-emitting thyristor L therein may be less dependent on temperature change. To meet the requirement, the light-emission amount needs to be corrected (light-emission amount correction needs to be performed) according to temperature change.

The light-emission amount of the light-emitting thyristor L of Comparative Example 1 increases as temperature rises. Thus, the light-emission amount correction may be performed on the light-emitting thyristor L of Comparative Example 1 by reducing the light-emission amount thereof as temperature rises. For example, this light-emission amount correction may be implemented by reducing current amount flowing through the light-emitting thyristor L, or reducing the length of the light-emission period thereof.

On the other hand, the light-emission amount of the light-emitting thyristor L of Comparative Example 2 decreases as temperature rises. Thus, the light-emission amount correction may be performed on the light-emitting thyristor L of Comparative Example 2 by increasing the light-emission amount thereof as temperature rises. For example, this light-emission amount correction may be implemented by increasing current amount flowing through the light-emitting thyristor L, or increasing the length of the light-emission period thereof.

That is, the correction direction is inverted between the light-emitting thyristors L of Comparative Examples 1 and 2.

The difference in the distance lc from the equivalent reflecting surface 152 to the semiconductor layer surface 92 between the light-emitting thyristors L of Comparative Examples 1 and 2 is only 50 nm. This difference of 50 nm is only 1.5% of the distance lc (3 μm) from the equivalent reflecting surface 152 to the semiconductor layer surface 92 in Comparative Example 1.

In manufacturing a light-emitting thyristor L, it is difficult to control the structure (control the film thickness, specifically) thereof with an accuracy of 50 nm or less. Accordingly, even if the light-emitting chips C constituting the light-emitting portion 63 are cut out from a single wafer, a thickness difference in the layers constituting each light-emitting thyristor L is highly likely to exceed 50 nm. If the light-emitting chips C are cut out from mutually different wafers, the possibility further increases. In addition, even in a light-emitting chip C, a thickness difference between a large-numbered one and a small-numbered one of the light-emitting thyristors L1 to L256 might exceed 50 nm in the layers constituting each light-emitting thyristor L.

Thus, in the light-emitting portion 63 in which a large number of light-emitting chips C are arrayed, the light-emitting thyristors L corresponding to Comparative Example 1, and the light-emitting thyristors L corresponding to Comparative Example 2 might mix together. This leads to a 3% difference in light-emission amount between the light-emitting thyristors L when temperature changes from 23 degrees C. to 63 degrees C. (Comparative Examples 1 and 2 in FIG. 10).

However, the light-emitting thyristors L corresponding to Comparative Example 1 are different from the light-emitting thyristors L corresponding to Comparative Example 2 in terms of the direction of the light-emission amount correction in response to temperature change, as described above. This makes it difficult to properly perform the light-emission amount correction by increasing or decreasing the light-emission amounts of the light-emitting thyristors L in the light-emitting portion 63 by a fixed percentage. That is, providing the distributed Bragg reflection layer 81 to each light-emitting thyristor L in order to increase the light use efficiency makes it difficult to properly perform the light-emission amount correction in response to temperature change.

Meanwhile, no light interference occurs in the light-emitting thyristors L not provided with the distributed Bragg reflection layer 81 (Comparative Example 3). Accordingly, only the influence of temperature change upon the bandgap needs to be taken into consideration. As a result, the direction of the light-emission amount change in the light-emission spectrum in response to temperature change is uniform between different wafers, between the light-emitting chips C, and the like. Accordingly, the light-emission amount correction may be properly performed by increasing or decreasing the light-emission amounts of all the light-emitting chips C in the light-emitting portion 63 by a fixed percentage in response to temperature change.

By contrast, the light extraction efficiency of the light-emitting thyristor L of Example is less wavelength dependent as shown in FIG. 11A. Thus, the light-emission spectrums (see FIG. 13) of Example reflect those (see FIG. 12) of the light-emitting thyristor L not provided with the distributed Bragg reflection layer 81 (Comparative Example 3). Accordingly, with temperature change, the light-emitting thyristor L of Example makes approximately the same change in light-emission amount as the light-emitting thyristor L not provided with the distributed Bragg reflection layer 81 (Comparative Example 3) does. Thus, the light-emission amount correction on the light-emitting thyristor L of Example in response to temperature change may be performed similarly to that on the light-emitting thyristor L not provided with the distributed Bragg reflection layer 81 (Comparative Example 3).

In Example, the difference $\Delta l_1$ (=la−lb) between the distances la and lb is set to 50 nm. This difference $\Delta l_1$ is determined so that difference in optical path length (product of the physical distance and the refractive index $u_1$ of the semiconductor layer 60) is equal to ¼ of the emission wavelength λ. That is, the difference Δl is calculated by substituting 1 for N in the expression: $\Delta l_1=(2\times N-1)\times\lambda/(4\times u_1)$ (N is an integer of 1 or more, and $u_1$ is the refractive index of the semiconductor layer 60). If the optical path lengths of light waves are different from each other by ¼ of the wavelength (by an odd-number multiple of ¼ of the wavelength, to be precise), the light waves are 90 degrees out of phase. Thus, the wavelengths at which light waves reflected by the convex portions 88 interfere constructively (wavelengths forming the standing waves) are equal to those at which light waves reflected by the concave portions 89 interfere destructively. On the other hand, the wavelengths at which light waves reflected by the concave portions 89 interfere constructively (wavelengths forming the standing waves) are equal to those at which light waves reflected by the convex portions 88 interfere destructively. Note that the emission wavelength λ needs only to be within the emission wavelength band, and may be the center wavelength or the wavelength of peak intensity.

As a result, the multiple wavelengths at which light waves reflected by the concave portions 89 interfere constructively (wavelengths at which the multiple standing waves exist) are located exactly in the intervals between the wavelengths at which light waves reflected by the convex portions 88 interfere constructively (wavelengths at which the multiple standing waves exist). Thereby, the wavelength dependencies of the light extraction efficiency of each convex portion 88 and each concave portion 89, respectively, are summed up to make the light extraction efficiency of Example less wavelength dependent. Therefore, the difference $\Delta l_1$ may satisfy the expression: $\Delta l_1=(2\times N-1)\times\lambda/(4\times u_1)$ (N is an integer of 1 or more, and $u_1$ is the refractive index of the semiconductor layer 60).

Note that the above relation does not depend on the distances la and lb. Accordingly, the thickness of the semiconductor layer 60 (the first to fourth semiconductor layers 82 to 85) constituting the light-emitting thyristor L need not be controlled at a high accuracy. Meanwhile, the difference $\Delta l_1$ of 50 nm in the present exemplary embodiment may be accurately set by photolithography as described above. The difference $\Delta l_1$ may alternatively be set to an odd-number multiple of 50 nm, such as 150 nm and 250 nm.

Next, a description will be given of the area relation between the convex portion 88 and the concave portion 89.

The light-emission intensity on the semiconductor layer surface 91 of the light-emitting thyristor L is not uniform. The light-emission intensity is high around the ohmic electrode 121 on the fourth semiconductor layer 85, and decreases with distance from the ohmic electrode 121.

Accordingly, the widths wa and wb respectively of each convex portion 88 and each concave portion 89 are both set to 2 μm in the light-emitting thyristor L of Example. This is because, by providing the convex portions 88 and the concave portions 89 on the semiconductor layer surface 91 with a pitch smaller than a change in light-emission intensity thereon, the light-emission amount of each convex portion 88 is made approximately equal to that of each concave portion 89.

Note that what is required here is only to make the light-emission amount of each convex portion 88 approximately equal to that of each concave portion 89. Hence, the convex portions 88 and the concave portions 89 are not necessarily formed with a small pitch as in Example.

Figure 17A:
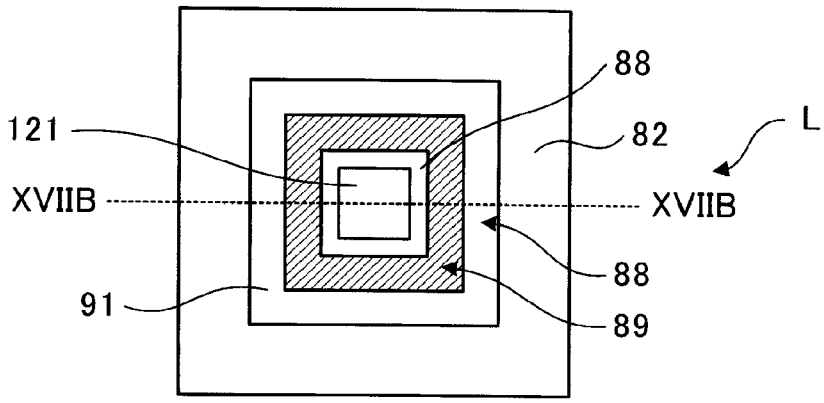
FIGS. 17A to 17C are diagrams for illustrating a configuration into which the convex portions and the concave portion may be formed in the surface of the fourth semiconductor layer.
Figure 17B:
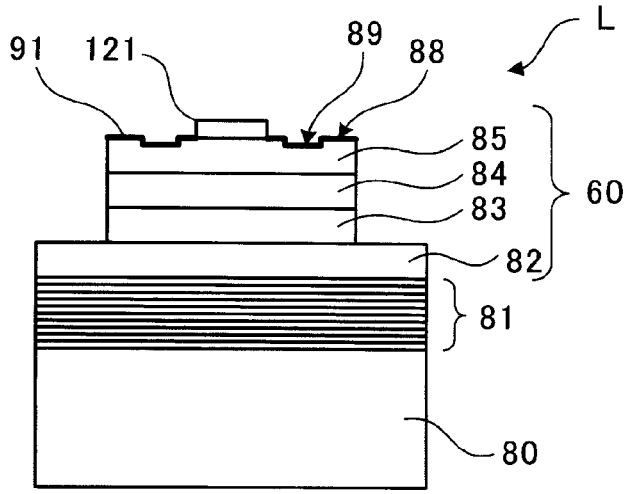
Figure 17C:
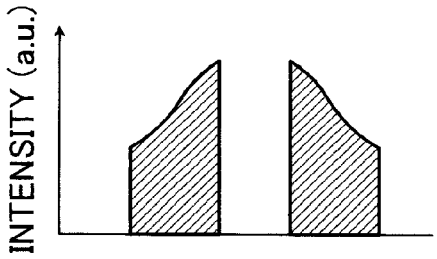

FIGS. 17A to 17C are diagrams for illustrating an example of a configuration into which the convex portions 88 and the concave portion 89 may be formed in the semiconductor layer surface 91. FIG. 17A is a plan view of the light-emitting thyristor L seen from the side from which emitted light is extracted (the side opposite to the substrate 80 side). FIG. 17B is a cross-sectional view of the light-emitting thyristor L taken along the XVIIB-XVIIB line of FIG. 17A. FIG. 17C shows the light-emission intensity of the light-emitting thyristor L on the XVIIB-XVIIB line of FIG. 17A.

The light-emitting thyristor L shown in FIGS. 17A to 17C has a pnpn structure formed by stacking the substrate 80, the distributed Bragg reflection layer 81 and the semiconductor layer 60 (the p-type first semiconductor layer 82, the n-type second semiconductor layer 83, the p-type third semiconductor layer 84 and the n-type fourth semiconductor layer 85). The surface of the light-emitting thyristor L is rectangular as shown in FIG. 17A.

In the semiconductor layer surface 91, a groove (concave portion 89) is formed surrounding the ohmic electrode 121. The regions surrounding the concave portion 89 are the convex portions 88. Note that FIGS. 17A to 17C do not show the protective film layer 87.

As shown in FIG. 17C, the light-emitting thyristor L emits light from the region, not provided with the ohmic electrode 121, of the surface of the semiconductor layer 60 (the semiconductor layer surface 91). The light-emission intensity of the light-emitting thyristor L is high around the center (around the ohmic electrode 121), and decreases with distance toward the peripheral (regions apart from the ohmic electrode 121) of the light-emitting thyristor L.

Thus, the area ratio between the convex portions 88 and the concave portions 89 may be set in consideration of the light-emission intensity so that the light-emission amount of the convex portions 88 is equal to that of the concave portions 89.

Figure 18A:
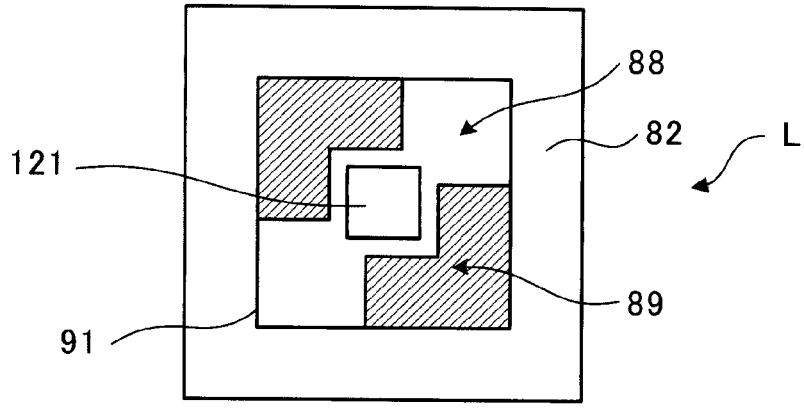
FIGS. 18A to 18C are diagrams for illustrating examples of configurations into which the concave portions may be formed.
Figure 18B:
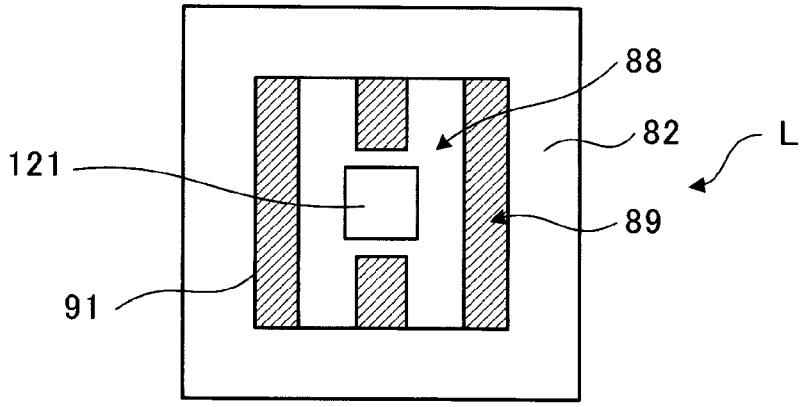
Figure 18C:
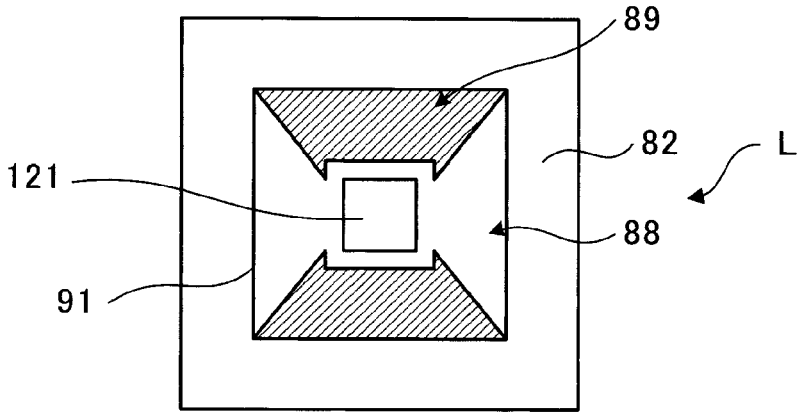

FIGS. 18A to 18C are diagrams for illustrating examples of shapes into which the concave portions 89 may be formed. Each of FIGS. 18A to 18C is a plan view of the light-emitting thyristor L similar to that shown in FIGS. 17A to 17C, seen from the side from which emitted light is extracted (the side opposite to the substrate 80 side). The cross-sectional structure of each light-emitting thyristor L is the same as that in FIG. 17B except for the shapes of the convex portions 88 and the concave portions 89.

In the light-emitting thyristor L shown in FIG. 18A, the two concave portions 89 are formed including two corners of the rectangular semiconductor layer surface 91. The region including the other two corners is the convex portion 88.

In the light-emitting thyristor L shown in FIG. 18B, the concave portions 89 are formed in three strips in the semiconductor layer surface 91. The other region is the convex portion 88.

In the light-emitting thyristor L shown in FIG. 18C, the two concave portions 89 are formed including two opposite sides of the rectangular semiconductor layer surface 91. The two convex portions 88 are formed including the other two opposite sides.

The area ratio between the convex portions 88 and the concave portions 89 in the semiconductor layer surface 91 may be set in consideration of the light-emission intensity so that the light-emission amount of the convex portions 88 is equal to that of the concave portions 89.

Second Exemplary Embodiment

Next, a second exemplary embodiment will be described. The present exemplary embodiment is approximately the same as the first exemplary embodiment, only differing in terms of which surface is made uneven. Note that in the present exemplary embodiment, the same components as those in the first exemplary embodiment are denoted by the same reference numerals, and the detailed description thereof will be omitted.

Figure 19:
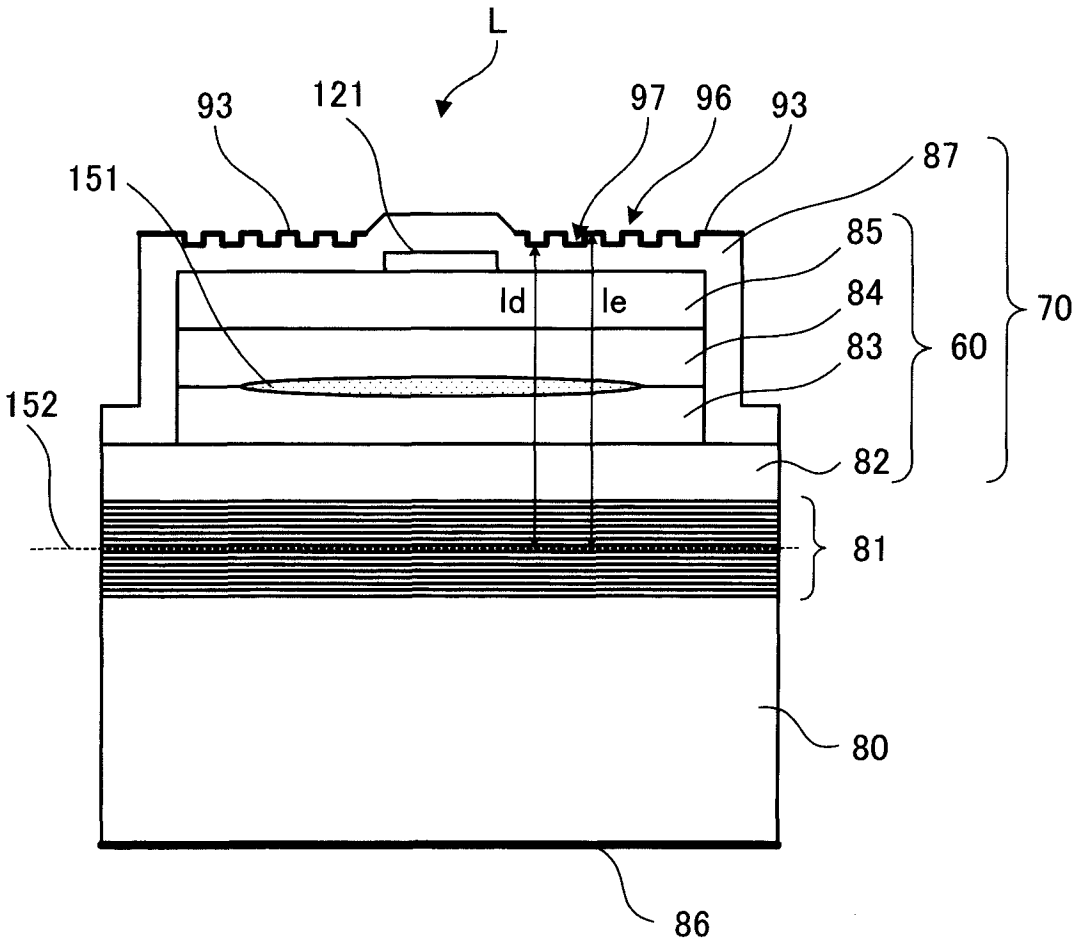
FIG. 19 is a diagram for illustrating a structure of the light-emitting thyristor according to the second exemplary embodiment.

FIG. 19 is a diagram for illustrating a structure of the light-emitting thyristor L according to the second exemplary embodiment.

In the light-emitting thyristor L according to the first exemplary embodiment, the semiconductor layer surface 91 is made uneven (provided with the convex portions 88 and the concave portions 89). In the light-emitting thyristor L according to the second exemplary embodiment, a protective film layer surface 93 is partially made uneven (provided with convex portions 96 and concave portions 97). The protective film layer surface 93 is the surface (the interface to the air), opposite to the surface in contact with the semiconductor layer 60, of the protective film layer 87, and is an example of the surface having unevenness at multiple distances from the reflection layer.

When the protective film layer 87 is made of $SiO_2$, 3.4% of light beams having a wavelength of 780 nm are reflected by the interface between the protective film layer 87 and the air, as described above. Thus, interference occurs between the light beams reflected by this interface and the light beams reflected by the distributed Bragg reflection layer 81. This makes the light extraction efficiency wavelength dependent, as in the first exemplary embodiment. As a result, the direction of light-emission amount change caused by temperature change (whether the light-emission amount increases or decreases as temperature rises) might vary between the light-emitting thyristors L.

To address this, the protective film layer surface 93 of the light-emitting thyristor L is made uneven (provided with the convex portions 96 and the concave portions 97). From the equivalent reflecting surface 152, each convex portion 96 and each concave portion 97 are separated by a distance le and a distance ld, respectively. Here, for the emission wavelength $\lambda$, the following relation may be satisfied: $\Delta l_2$ (=le−ld)=$(2\times N-1)\times\lambda/(4\times u_2)$ (N is an integer of 1 or more, and $u_2$ is the refractive index of the protective film layer 87).

This makes the light extraction efficiency less wavelength dependent, and thus facilitates the light-emission amount correction in response to temperature change.

Assume that the refractive index $u_2$ of the protective film layer 87 for light having a wavelength $\lambda$ around 780 nm is 1.45, for example. In this case, $\Delta l_2$ is 134 nm with N=1. The difference $\Delta l_2$ of 134 nm is larger than the difference $\Delta l_1$ of 50 nm in the first exemplary embodiment. Accordingly, by making the protective film layer 87 uneven, the required accuracy in manufacturing the light-emitting thyristor L may be loosened.

Third Exemplary Embodiment

Next, a third exemplary embodiment will be described.

Figure 20:
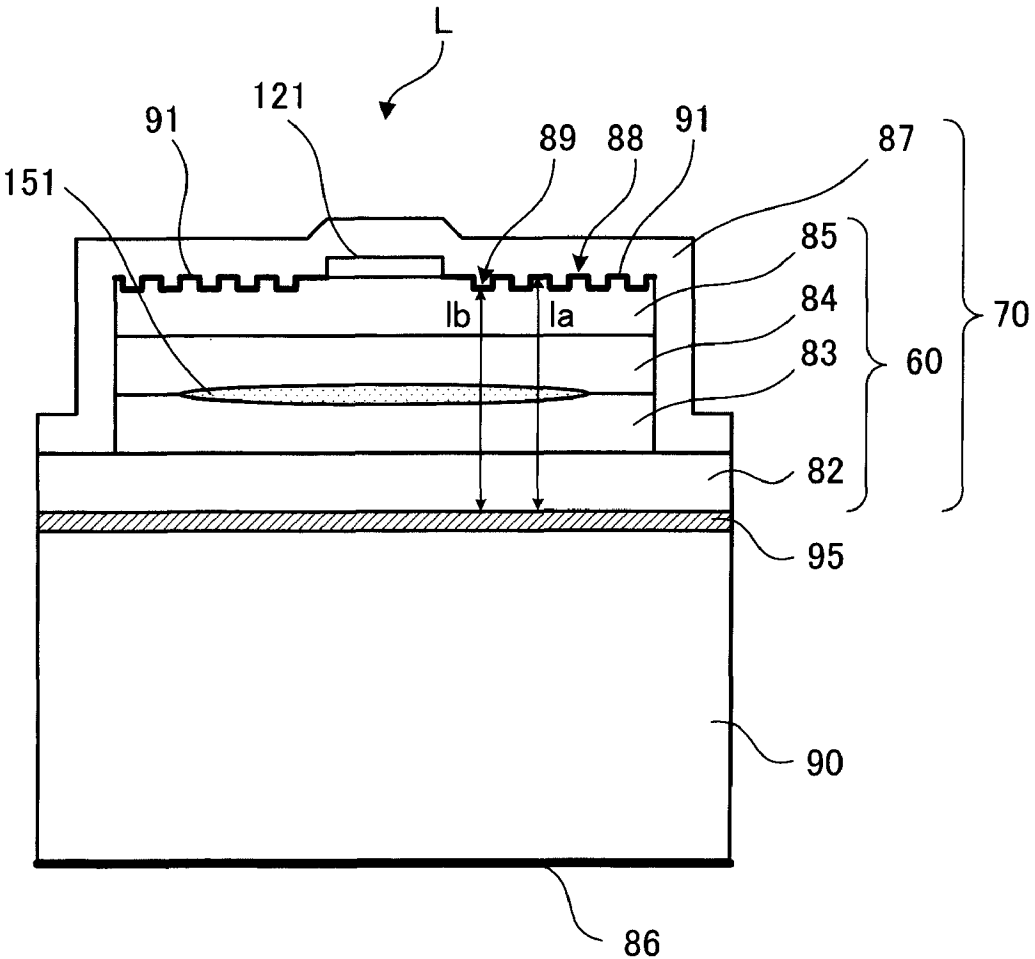
FIG. 20 is a diagram for illustrating a structure of the light-emitting thyristor according to the third exemplary embodiment.

FIG. 20 is a diagram for illustrating a structure of the light-emitting thyristor L according to the third exemplary embodiment.

The present exemplary embodiment is approximately the same as the first exemplary embodiment, only differing in terms of the reflection layer. That is, as the reflection layer, the light-emitting thyristor L according to the first exemplary embodiment uses the distributed Bragg reflection layer 81, but the light-emitting thyristor L according to the third exemplary embodiment uses a reflection layer (metal reflection layer) 95 made, for example, of metal.

Note that in the present exemplary embodiment, the same components as those in the first exemplary embodiment are denoted by the same reference numerals, and the detailed description thereof will be omitted.

Hereinafter, a method for manufacturing each light-emitting chip C1 according to the third exemplary embodiment will be described in brief.

Firstly, the same light-emitting chip C1 as that shown in FIGS. 6A and 6B except that the distributed Bragg reflection layer 81 is not included therein is manufactured. That is, the semiconductor layer 60 (structure formed by stacking the p-type first semiconductor layer 82, the n-type second semiconductor layer 83, the p-type third semiconductor layer 84 and the n-type fourth semiconductor layer 85 in this order) is formed on the substrate 80.

Then, the gate-exposing etching is performed on the fourth semiconductor layer 85 made of GaAs to remove regions where the gate terminals G and the resistors R are to be formed. Thereafter, the element isolation etching is performed to form the islands such as the first islands 141 and the second islands 142. After that, the concave portions 89 are formed by photolithography in the surface of the n-type fourth semiconductor layer 85 in each light-emitting thyristor L, and thus the uneven semiconductor layer surface 91 is formed.

Then, the ohmic electrodes 121 and the like are formed. After that, the protective film layer 87 is formed, and the through holes are provided therein. Thereafter, the metal interconnects are provided.

Then, the substrate 80 is removed by performing mechanical or chemical etching from the substrate 80 side.

Apart from the substrate 80, a substrate 90 provided with the metal reflection layer 95 made of a material having high reflectance for light having a wavelength of 780 nm, such as Al, is manufactured. The above-described light-emitting chip C1 from which the substrate 80 is removed is bonded onto the substrate 90.

The distance la is a distance between each convex portion 88 of the semiconductor layer surface 91 and the surface, in contact with the semiconductor layer 60, of the metal reflection layer 95. Similarly, the distance lb is a distance between each concave portion 89 of the semiconductor layer surface 91 and the surface, in contact with the semiconductor layer 60, of the metal reflection layer 95. For the emission wavelength λ, the difference $\Delta l_1$ between the distances la and lb may satisfy the following relation: $\Delta l_1=(2\times N-1)\times\lambda/(4\times u_1)$ (N is an integer of 1 or more, and $u_1$ is the refractive index of the semiconductor layer 60) as in the first exemplary embodiment. The distances la and lb are regarded as distances from the reflection layer.

In the light-emitting thyristor L according to the third exemplary embodiment, interference occurs between light beams traveling toward the metal reflection layer 95 after reflected by the semiconductor layer surface 91 (the interface between the fourth semiconductor layer 85 and the protective film layer 87) and the light beams traveling toward the semiconductor layer surface 91 after reflected by the metal reflection layer 95. However, the wavelengths at which light waves reflected by the convex portions 88 interfere constructively are shifted by ¼ of the wavelengths from those at which light waves reflected by the concave portions 89 interfere constructively. This makes the light extraction efficiency of the light-emitting thyristor L less wavelength dependent, and thus facilitates the light-emission amount correction in response to temperature change, as in the first exemplary embodiment.

In the first to third exemplary embodiments, the difference $\Delta l_1$ ($\Delta l_2$) between each convex portion 88 (96) and each concave portion 89 (97) is determined so that difference in optical path length (product of the physical distance and the refractive index) is equal to ¼ of the emission wavelength λ. However, the difference is not limited to the value. It is only necessary to locate the wavelengths at which the multiple standing waves reflected by the concave portions 89 exist exactly in the intervals between the wavelengths at which the multiple standing waves reflected by the convex portions 88 exist.

Moreover, although the semiconductor layer surface 91 or the protective film layer surface 93 is formed of regions of two types mutually different in distance from the equivalent reflecting surface 152 (the convex portions 88 (96) and the concave portions 89 (97)) in the present exemplary embodiments, another type of regions separated by a different distance from the equivalent reflecting surface 152 may be additionally provided. It is only necessary to locate the wavelengths at which light waves reflected by regions of one distance interfere constructively exactly in the intervals between the wavelengths at which light waves reflected by regions of another distance interfere constructively. Assume that the number of different distances is M (M is an integer of 2 or more), for example. Then, for the emission wavelength λ, the difference Δl ($\Delta l_1$ or $\Delta l_2$) between these different distances may satisfy the following relation: $\Delta l=(2\times N-1)\times\lambda/(2\times M\times u)$ (N is an integer of 1 or more, and u is the refractive index $u_1$ of the semiconductor layer 60 or the refractive index $u_2$ of the protective film layer 87). This allows the crests (peaks) of the light extraction efficiency from regions of one distance to be located in the intervals between the crests (peaks) of the light extraction efficiency from regions of another distance. As a result, the light extraction efficiency of the light-emitting thyristor L becomes much less wavelength dependent.

Note that, in the first to third exemplary embodiments, a thyristor whose anode terminal is set to the reference potential Vsub (anode common thyristor) is used, as each of the light-emitting thyristors L and the transfer thyristors T. However, by changing polarities of a circuit, a thyristor whose cathode terminal is set to the reference potential Vsub (cathode common thyristor) is used as each of the light-emitting thyristors L and the transfer thyristors T.

In the first to third exemplary embodiments, the light-emitting element chips C are formed of a GaAs-based semiconductor, but the material of the light-emitting element chips C is not limited to this. For example, the light-emitting element chips C may be formed of another composite semiconductor difficult to turn into a p-type semiconductor or an n-type semiconductor by ion implantation, such as GaP.

In addition, although the light-emitting thyristors L are used as the light-emitting elements in the first to third exemplary embodiments, light emitting diodes may be used instead. Moreover, light-emitting elements made of an organic material (organic electroluminescence (EL) elements), may alternatively be used as the light-emitting elements.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting device comprising:

a substrate;

a reflection layer that is provided on the substrate, and that reflects light in a wavelength band set in advance; and a light-emitting layer that is provided on the reflection layer, and that includes a light-emitting region emitting light having wavelengths overlapping in the wavelength band and a surface having unevenness at a plurality of distances from the reflection layer, the surface being provided on a side opposite to the reflection layer across the light-emitting region, the plurality of distances being set so that wavelengths forming standing waves depending on each of the distances in the wavelength band are interposed each other, wherein the light-emitting layer is formed on the reflection layer and includes a semiconductor layer that has the light-emitting region, and the surface having unevenness at the plurality of distances from the reflection layer is a surface of the semiconductor layer opposite to a surface of the semiconductor layer in contact with the reflection layer, and the light emitted by the light-emitting layer includes, within the wavelength band where the reflecting layer reflects light, a plurality of standing waves corresponding to concave portions of the surface having unevenness and a plurality of standing waves corresponding to convex portions of the surface having unevenness.

2. The light-emitting device according to claim 1, wherein the semiconductor layer that the light-emitting layer includes is a thyristor structure.

3. The light-emitting device according to claim 1, wherein the semiconductor layer that the light-emitting layer includes is a light emitting diode structure.

4. The light-emitting device according to claim 1, wherein the reflection layer is a distributed Bragg reflection layer.

5. The light-emitting device according to claim 1, wherein the reflection layer is a metal reflection layer.

6. A print head comprising:

an exposure unit that includes a light-emitting device and that exposes an image carrier; and an optical unit that focuses light emitted by the exposure unit onto the image carrier, the light-emitting device including:

a substrate;

a reflection layer that is provided on the substrate, and that reflects light in a wavelength band set in advance; and a light-emitting layer that is provided on the reflection layer, and that includes a light-emitting region emitting light having wavelengths overlapping in the wavelength band and a surface having unevenness at a plurality of distances from the reflection layer, the surface being provided on a side opposite to the reflection layer across the light-emitting region, the plurality of distances being set so that wavelengths forming standing waves depending on each of the distances in the wavelength band are interposed each other, wherein the light-emitting layer is formed on the reflection layer and includes a semiconductor layer that has the light-emitting region, and the surface having unevenness at the plurality of distances from the reflection layer is a surface of the semiconductor layer opposite to a surface of the semiconductor layer in contact with the reflection layer, and the light emitted by the light-emitting layer includes, within the wavelength band where the reflecting layer reflects light, a plurality of standing waves corresponding to concave portions of the surface having unevenness and a plurality of standing waves corresponding to convex portions of the surface having unevenness.

7. An image forming apparatus comprising:

a charging unit that charges an image carrier;

an exposure unit that includes a light-emitting device and that exposes the image carrier;

an optical unit that focuses light emitted by the exposure unit onto the image carrier;

a developing unit that develops an electrostatic latent image formed on the image carrier; and a transfer unit that transfers an image developed on the image carrier onto a transferred body, the light-emitting device including:

a substrate;

a reflection layer that is provided on the substrate, and that reflects light in a wavelength band set in advance; and a light-emitting layer that is provided on the reflection layer, and that includes a light-emitting region emitting light having wavelengths overlapping in the wavelength band and a surface having unevenness at a plurality of distances from the reflection layer, the surface being provided on a side opposite to the reflection layer across the light-emitting region, the plurality of distances being set so that wavelengths forming standing waves depending on each of the distances in the wavelength band are interposed each other, wherein the light-emitting layer is formed on the reflection layer and includes a semiconductor layer that has the light-emitting region, and the surface having unevenness at the plurality of distances from the reflection layer is a surface of the semiconductor layer opposite to a surface of the semiconductor layer in contact with the reflection layer, and the light emitted by the light-emitting layer includes, within the wavelength band where the reflecting layer reflects light, a plurality of standing waves corresponding to concave portions of the surface having unevenness and a plurality of standing waves corresponding to convex portions of the surface having unevenness.

* * * * *